US008477953B2

(12) United States Patent
Hobson et al.

(10) Patent No.: US 8,477,953 B2
(45) Date of Patent: Jul. 2, 2013

(54) PORTABLE MEDIA DELIVERY SYSTEM

(75) Inventors: Phil Hobson, Menlo Park, CA (US); Donald J. Novotney, San Jose, CA (US); Ida Yum Yum Lo, Saratoga, CA (US); Jesse L. Dorogusker, Los Altos, CA (US); Richard P. Howarth, San Francisco, CA (US); Jeffrey Allan Hammerstrom, San Carlos, CA (US); Victor M. Tiscareno, Issaquah, WA (US); Scott Krueger, San Francisco, CA (US); Jeffrey J. Terlizzi, San Francisco, CA (US); John Benjamin Filson, San Jose, CA (US); Wey-Jiun Lin, Los Altos Hills, CA (US); Jose Natividad Martinez, San Jose, CA (US); Eric B. Greene, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1599 days.

(21) Appl. No.: 11/696,059

(22) Filed: Apr. 3, 2007

(65) Prior Publication Data

US 2007/0230723 A1 Oct. 4, 2007

Related U.S. Application Data

(63) Continuation-in-part of application No. 11/363,649, filed on Feb. 27, 2006, now abandoned.

(60) Provisional application No. 60/810,241, filed on Jun. 1, 2006.

(51) Int. Cl.
*H04R 29/00* (2006.01)

(52) U.S. Cl.
USPC ..... 381/59

(58) Field of Classification Search
USPC ..... 381/300, 59, 307, 391, 386, 189, 381/334, 123, 98, 101, 102, 104; 181/148, 181/150, 171, 199; 361/679.23; 455/575.1
See application file for complete search history.

(56) References Cited

U.S. PATENT DOCUMENTS 3,693,089 A * 9/1972 Hutchinson et al. ..... 455/351
4,546,850 A 10/1985 Litner (Continued)

FOREIGN PATENT DOCUMENTS

DE 255 833 4/1988
GB 2305810 4/1997

(Continued)

OTHER PUBLICATIONS

"Keyspan Express Remote Supports Apple's Airport Express," Press Release, Keyspan, Nov. 10, 2004.

(Continued)

*Primary Examiner* — Lun-See Lao
(74) *Attorney, Agent, or Firm* — Kilpatrick Townsend & Stockton

(57) ABSTRACT

An improved media delivery apparatus is disclosed. The media delivery apparatus can, for example, be a portable speaker system. In one embodiment, the media delivery apparatus is used with a portable media player. According to one aspect, audio output characteristics of a media delivery apparatus can be controlled based on whether a removable component is attached or detached. Another aspect pertains to improved techniques to attach a removable component to a media delivery apparatus. According to still another aspect a portion of a housing of an electrical device, such as a media delivery apparatus, can be utilized as part of a connector or plug.

28 Claims, 13 Drawing Sheets

U.S. PATENT DOCUMENTS

| | | | | |
|---|---|---|---|---|
| 4,993,739 | A * | 2/1991 | Putnam | 280/511 |
| 5,035,646 | A | 7/1991 | Ehrenfels et al. | |
| 5,604,663 | A | 2/1997 | Shin et al. | |
| 5,652,413 | A * | 7/1997 | Mulera | 181/141 |
| 5,917,695 | A * | 6/1999 | Youn | 361/679.27 |
| 6,041,128 | A | 3/2000 | Narisawa et al. | |
| 6,914,551 | B2 | 7/2005 | Vidal | |
| 7,346,181 | B2 * | 3/2008 | Rivera | 381/391 |
| 7,399,198 | B2 * | 7/2008 | Thalheimer et al. | 439/501 |
| 7,574,177 | B2 | 8/2009 | Tupman et al. | |
| 7,580,255 | B2 | 8/2009 | Crooijmans et al. | |
| 7,616,775 | B2 * | 11/2009 | Chang | 381/391 |
| 7,627,343 | B2 | 12/2009 | Fadell et al. | |
| 7,719,830 | B2 | 5/2010 | Howarth et al. | |
| 7,823,214 | B2 | 10/2010 | Rubinstein et al. | |
| 2002/0048982 | A1 | 4/2002 | Gu et al. | |
| 2005/0009579 | A1 * | 1/2005 | Chen et al. | 455/575.1 |
| 2005/0142927 | A1 | 6/2005 | Chen | |
| 2005/0281429 | A1 | 12/2005 | Rivera | |
| 2006/0013411 | A1 | 1/2006 | Lin | |
| 2007/0080823 | A1 | 4/2007 | Fu et al. | |
| 2007/0169115 | A1 | 7/2007 | Ko et al. | |

FOREIGN PATENT DOCUMENTS

| | | |
|---|---|---|
| JP | 2000200116 | 7/2000 |
| JP | 2000354287 | 12/2000 |
| WO | WO01/86922 | 11/2001 |

OTHER PUBLICATIONS

"Keyspan Express Remote," Product Fact Sheet, Keyspan.
Express Remote (URM-17A), product information datasheet, Keyspan, http://www.keyspan.com/products/usb/urm15t, downloaded Sep. 25, 2005, pp. 1-2.
International Search Report dated Jul. 20, 2007 in corresponding Application No. PCT/US2007/004809.
Keyspan: DMR Software v1.3 for Mac OS X—User Manual, rev. 04.09.01A1, Keyspan.
Remote for iTunes (URM-15T), product information datasheet, Keyspan, http://www.keyspan.com/products/usb/urm15t, downloaded Sep. 25, 2005, pp. 1-2.
Salling Clicker 2.2.1, User Manual, Salling Software AB, 2005.
International Search Report dated Nov. 6, 2007 in corresponding Application No. PCT/US2007/004809.
Written Opinion dated Nov. 6, 2007 in corresponding Application No. PCT/US2007/004809.

* cited by examiner

PORTABLE MEDIA DELIVERY SYSTEM

CROSS-REFERENCE TO RELATED APPLICATIONS

This application is a continuation-in-part of U.S. patent application Ser. No. 11/363,649, filed Feb. 27, 2006, and entitled "PORTABLE MEDIA DELIVERY SYSTEM," which is hereby incorporated herein by reference that is also related to: (i) U.S. patent application Ser. No. 10/423,490, filed Apr. 25, 2003, entitled "MEDIA PLAYER SYSTEM," which is hereby incorporated herein by reference; (ii) U.S. patent application Ser. No. 11/051,499, filed Feb. 23, 2005, entitled "ACCESSORY AUTHENTICATION FOR ELECTRONIC DEVICES," which is hereby incorporated herein by reference; (iii) U.S. application Ser. No. 11/125,883 filed May 9, 2005 entitled "UNIVERSAL DOCKING STATION FOR HAND HELD ELECTRONIC DEVICES", which is hereby incorporated herein by reference; (iv) U.S. application Ser. No. 11/212,302 filed Aug. 24, 2005 entitled "DOCKING STATION FOR HAND HELD ELECTRONIC DEVICES", which is herein incorporated by reference; (v) U.S. patent application Ser. No. 11/245,937, filed Oct. 7, 2005, entitled "TECHNIQUES FOR PAIRING REMOTE CONTROLLERS WITH HOST DEVICES," which is hereby incorporated herein by reference; and (vi) U.S. patent application Ser. No. 11/326,169, filed Jan. 4, 2006, entitled "REMOTE CONTROLLER AND FM RECEPTION ARRANGEMENT," which is hereby incorporated herein by reference. This application also claims priority to U.S. Provisional Patent Application No. 60/810,241, filed Jun. 1, 2006, and entitled "PORTABLE MEDIA DELIVERY SYSTEM," which is hereby incorporated herein by reference.

BACKGROUND OF THE INVENTION

1. Field of the Invention

The present invention relates to media devices and, more particularly, to portable media devices, such as portable media players, that couple to accessory devices.

2. Description of the Related Art

A media player stores media assets, such as audio tracks or photos, that can be played or displayed on the media player. One example of a media player is the iPod® media player, which is available from Apple Computer, Inc. of Cupertino, Calif. Often, a media player acquires its media assets from a host computer that serves to enable a user to manage media assets. As an example, the host computer can execute a media management application to manage media assets. One example of a media management application is iTunes® produced by Apple Computer, Inc.

A media player typically includes one or more connectors or ports that can be used to interface to the media player. For example, the connector or port can enable the media player to (i) couple to a host computer, (ii) be inserted into a docking system, or (iii) connect to an accessory device. There are today many different types of accessory devices that can interconnect to the media player. For example, a remote control can be connected to the connector or port to allow the user to remotely control the media player. As another example, an automobile can include a connector and the media player can be inserted onto the connector such that an automobile media system can interact with the media player, thereby allowing the media content on the media player to be played within the automobile media system. As still another example, a media player can be connected to a speaker dock, which can then serve as a portable media system or sound system.

Notwithstanding the foregoing, there is a need for improved interaction between media devices and accessory devices. There is also a need for improved design of accessories that produce audible sounds.

SUMMARY OF THE INVENTION

The invention pertains to an improved media delivery apparatus. The media delivery apparatus can, for example, be a portable speaker system. In one embodiment, the media delivery apparatus is used with a portable media player. The media delivery apparatus can also be referred to as a sound system.

The invention can be implemented in numerous ways, including as a method, system, device, apparatus (including graphical user interface), or computer readable medium. Several embodiments of the invention are discussed below.

The invention, in one embodiment, relates to a media delivery apparatus. The media delivery apparatus includes at least: an audio output subsystem that produces audio signals; at least one speaker operatively connect to receive the audio signals from said audio output circuit; a removable cover for said at least one speaker; and a cover detection circuit operatively connected to provide a cover detection signal to said audio output subsystem based on whether or not said removable cover is attached or not. The audio signals supplied to said at least one speaker have at least one audio characteristic that varies depending on the cover detection signal.

The invention, in another embodiment, relates to a media delivery apparatus. The media delivery apparatus includes at least: a controller for controlling output of media data; an audio output circuit operatively connected to said controller for receiving the media data and producing audio signals; at least one speaker operatively connect to receive the audio signals from said audio output circuit; a removable grill to cover said at least one speaker; and a grill detection circuit operatively connected to provide a grill detection signal to at least one of said controller and said audio output circuit. At least one of said controller and said audio output circuit operates to alter audio characteristics of the resulting audio output from said at least one speaker dependent on the grill detection signal.

The invention, in another embodiment, relates to a method for modifying audio output by a media delivery apparatus. The media delivery apparatus having a housing including audio output circuitry and one or more speakers. The media delivery apparatus also having a removable cover to cover at least the one or more speakers. The method including at least the acts of: determining whether the removable cover is attach or removed from the housing; and altering equalization characteristics imposed by the audio output circuitry dependent on whether the removable cover is determined to be attached or removed.

The invention relates, in one embodiment, to a portable sound system for docking a handheld media player. The sound system includes a housing forming at least partially a speaker box. The sound system also includes one or more speaker drivers mounted to a front wall of the housing. The speaker drivers are configured to output sound based on audio signals generated at the media player. The sound system further includes a removable speaker grill that is detachably coupled to the front wall of the housing via a mounting arrangement. The speaker grill has a shape that coincides with the shape of the front wall of the housing. The mounting arrangement minimizes the gap found between the speaker grill and the housing wall. The sound system additionally includes a docking station integrated within a top wall of the housing of the sound system. The docking station allows the handheld media player to interact with the portable sound system, the docking station includes a media bay capable of physically receiving the handheld media player and a connector arrangement disposed within the media bay for operatively coupling the handheld media player to the operational components of the portable sound system.

The invention relates, in another embodiment, to a sound system. The sound system includes a housing having a housing wall with an access opening and a slot disposed within the access opening. The sound system also includes a removable access door for placement inside the access opening. The removable access door includes a retention plate that slides in and out of an opening in the removable access door. The retention plate slides between a disengaged position where the retention plate is contained within the perimeter of the removable access door, and an engaged position where the retention plate extends out of and past the perimeter of the removable access door in order to mate with the slot disposed within the access opening thereby securing the removable access door within the access opening of the housing wall.

The invention relates, in still another embodiment, to a mounting arrangement for detachably coupling a speaker grill to a housing of a sound system. The mounting arrangement includes a housing-side mount attached to the housing of the sound system. The housing-side mount includes a receptacle and a holding detect mechanism within the receptacle. The mounting arrangement also includes a grill-side mount attached to the speaker grill. The grill-side mount including a post that is inserted into the receptacle and held in the receptacle by the holding detent mechanism.

The invention relates, in yet another embodiment, to a power plug system for a sound system. The power plug system includes a portion of housing wall of the sound system. The housing wall includes an opening for receiving a connector therethrough. The power plug system also includes a fixture mounted to an inner surface of the housing wall so that an outer surface of the housing wall is continuous. The fixture includes a body having a void for receiving the connector therein, and electrical contacts disposed inside and extending outside the void, the void cooperating with the opening to form the interior space that receives the connector. The electrical contacts extend partially into the opening in the housing wall.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention pertains to an improved media delivery apparatus. The media delivery apparatus can, for example, be a portable speaker system. In one embodiment, the media delivery apparatus is used with a portable media player. The media delivery apparatus can also be referred to as a sound system.

The improved media delivery device can include one or more different aspects. One aspect of the invention pertains to controlling audio output characteristics of a media delivery apparatus based on whether a removable component is attached or detached. Another aspect of the invention pertains to improved techniques to attach a removable component to a media delivery apparatus. Still another aspect of the invention concerns utilization of a portion of a housing of an electrical device, such as a media delivery apparatus, as part of a connector or plug.

Embodiments of various aspects of the invention are discussed below with reference to FIGS. 1-16. However, those skilled in the art will readily appreciate that the detailed description given herein with respect to these figures is for explanatory purposes as the invention extends beyond these limited embodiments.

One aspect of the invention pertains to controlling audio output characteristics of a media delivery apparatus based on whether a removable component is attached or detached. In particular, the removable component can be a cover (e.g., grill) for a speaker of the media delivery apparatus. The audio characteristics that are being controlled dependent on the presence or absence of the cover can include equalization settings. Advantageously, given that the presence of the grill on the housing affects the audio characteristics of the media delivery apparatus, the ability to utilize different equalization settings dependent upon the presence or absence of the cover yields an improved media delivery apparatus.

Figure 1:
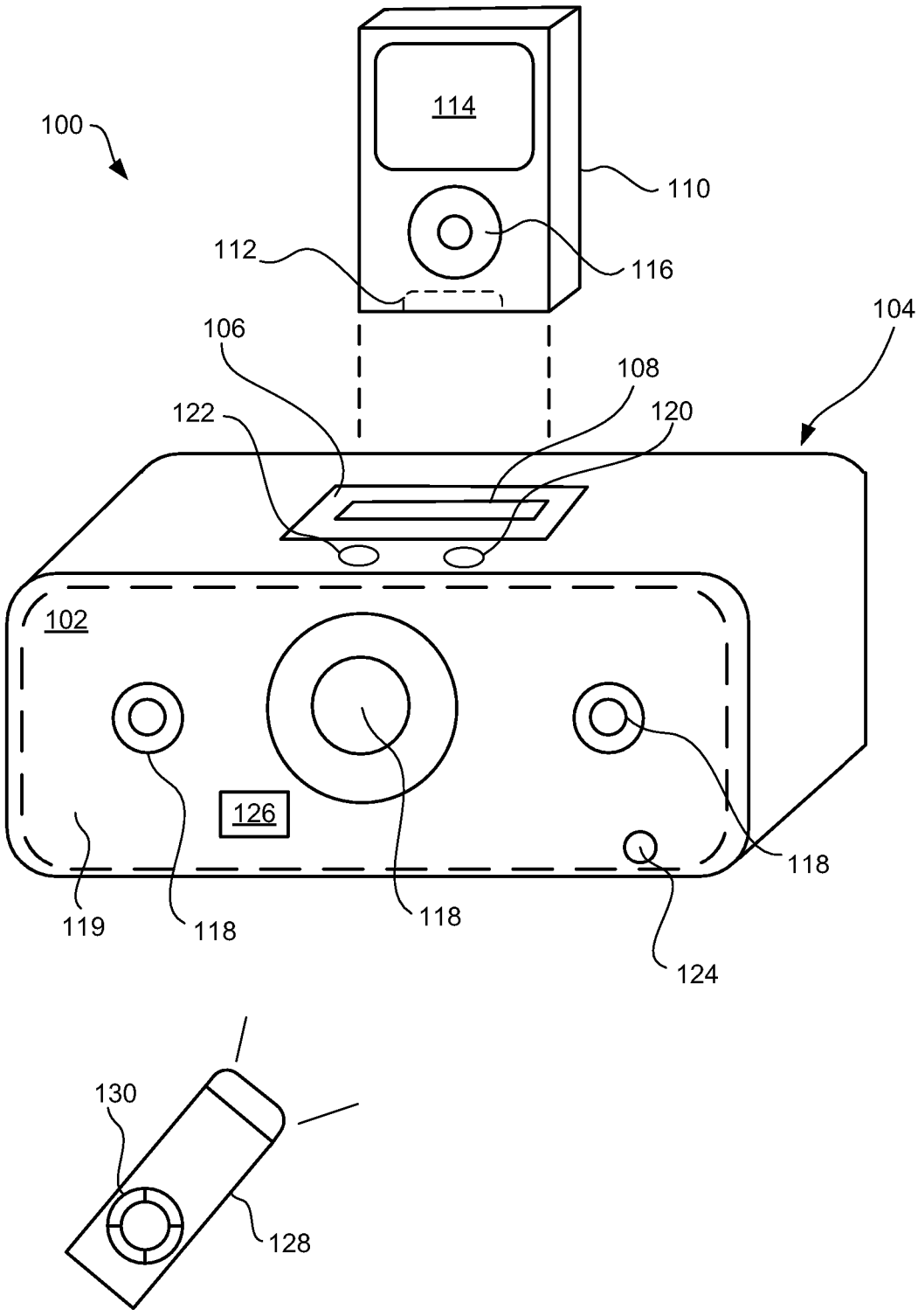
FIG. 1 is a diagram of a media system according to one embodiment of the invention.

FIG. 1 is a diagram of a media system 100 according to one embodiment of the invention. The media system 100 includes a media delivery apparatus 102. The media delivery apparatus 102 serves to output media, such as outputting audio sounds. For example, the audio sound can pertain to music. The media delivery apparatus 102 can also be referred to as a media delivery accessory. More particularly, the media delivery apparatus 102 can be considered a speaker system.

The media delivery apparatus 102 includes a housing 104 that supports or contains various components of the media delivery apparatus 102. The housing 104 includes an opening or receptacle 106 and a connector 108 disposed therein. Besides the media delivery apparatus 102, the media system 100 also includes a portable media player 110. The portable media player 110 is, more generally, a portable computing device, such as the portable media device 102 illustrated in FIG. 1. The portable media player 110 includes a connector 112, a display 114 and a user input device 116. The user input device 116 can, for example, be a touch pad, a dial, a wheel, and/or a button. As shown in FIG. 1, the exemplary user input device 116 depicted is a circular touchpad that supports rotational inputs and may include a center button. Typically, the portable media player 110 is a battery-powered media playback device. The battery-powered media playback devices can be highly portable, such as handheld or pocket-sized media players. Examples of portable media device include media players (e.g., MP3 players or video players), cell phones having media support, and PDAs.

Although the portable media player 110 is fully operational apart from the media delivery apparatus 102, the portable media player 110 can be connected to the media delivery apparatus 104. In particular, the portable media player 110 includes the connector 112. The portable media player 110 can be placed in the opening or receptacle 106 such that the connector 108 physically and electrically connects with the connector 112 of the portable media player 110, thereby connecting the portable media player 110 to the media delivery apparatus 104. The opening or receptacle 106 can also be considered a media bay opening for removably receiving the portable media player 110.

The media delivery apparatus 102 includes a plurality of speakers 118. In one embodiment, the speakers 118 include a pair of midrange speakers and a subwoofer speaker. The media delivery apparatus 102 can further provide a cover 119 that can be removable be attached to the front of the housing 102 such that one or more of the speakers 118 can be covered. The cover 119 is, for example, a speaker grill. Typically, the cover 119 is decorative so as to provide a uniform and more aesthetic look for the front of the housing 102 when attached. In FIG. 1, the front of the housing 102 is shown with the cover 119 removed; however, the representative placement for the cover 119 with is depicted as a dotted line. The housing 104 also includes volume control devices 120 and 122. In one embodiment, the volume control devices 120 and 122 are buttons. Still further, the housing 104 can include an indicator light 124 that is operated to provide visual feedback to the user regarding the operation or condition of the media delivery apparatus 102. The housing 104 can also include an infrared receiver window 126 that can be used by an infrared receiver internal to the housing 104 when picking up wireless infrared transmissions from a remote controller 128. In the embodiment shown in FIG. 1, the remote controller 128 includes a plurality of user input controls 130. Through use of the user input controls 130 on the remote controller 128, the user is able to indirectly interact with the portable media player 110 or directly interact with the media delivery apparatus 102. For example, the user of the remote controller 128 can interact with the user input controls 130 to select a media item to be played on the portable media player 110 with its audio output being provided by the speakers 118 of the media delivery apparatus 102. The remote controller 128 can also be used to alter the volume of the audio output from the media delivery apparatus 102.

Figure 2A:
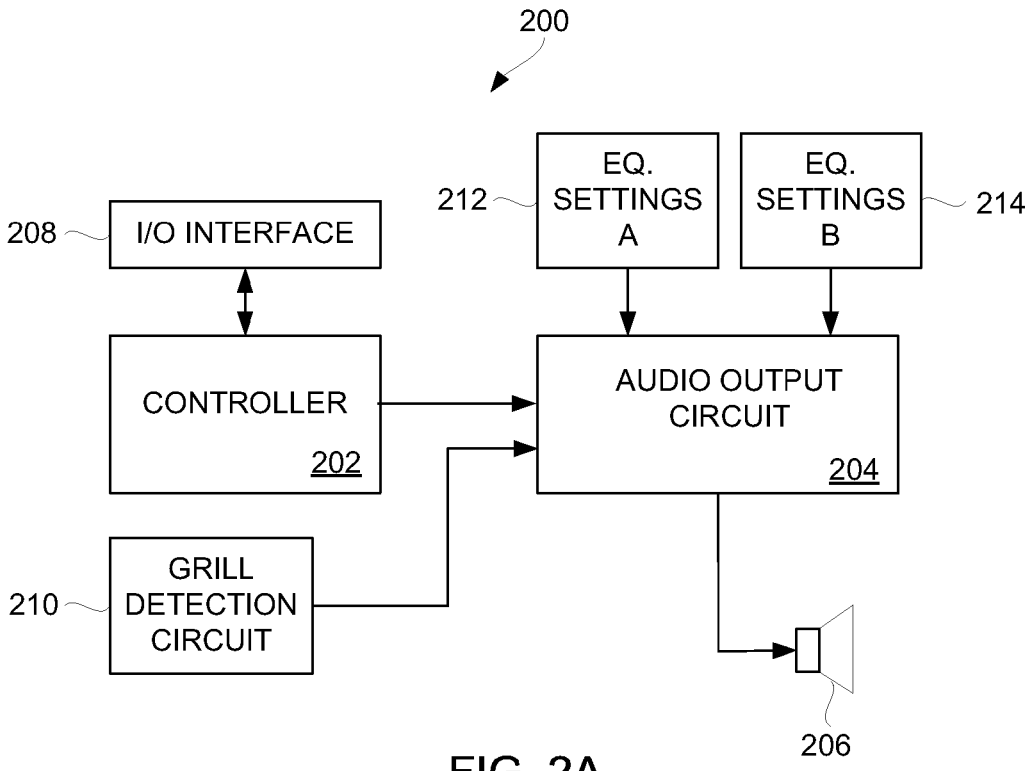
FIG. 2A is a block diagram of an audio delivery apparatus according to one embodiment of the invention.

FIG. 2A is a block diagram of an audio delivery apparatus 200 according to one embodiment of the invention. As an example, the audio delivery apparatus 200 can represent audio delivery circuitry within the media delivery apparatus 102 illustrated in FIG. 1.

The audio delivery apparatus 200 includes a controller 202, an audio output circuit 204 and a speaker 206. The controller 202 receives media data to be output by the audio output circuit 204 via the speaker 206. The controller 202 can, for example, receive the media data from an internal data storage device or from an input/output (I/O) interface 208. For example, the I/O interface 208 can permit connection to a media storage device, such as a removable data storage device, a portable media player or a network-based media storage device.

The audio delivery apparatus 200 is provided within a housing and has a grill that is removable with respect to the housing. A grill detection circuit 210 is provided to determine whether the grill is attached or detached from the housing for the audio delivery apparatus 200. The grill detection circuit 210 provides a grill detection signal to the audio output circuit 204. According to one embodiment, the audio output circuit 204 can output audio signals to the speaker 206 in accordance with equalization settings that are determined dependent upon the grill detection signal. The audio delivery apparatus 200 has equalization settings A 212 and equalization settings B 214 available for usage. When the grill detection signal detects that the grill is attached to the housing, then the equalization settings A 212 can be utilized by the audio detection circuit 204 in producing the output signals for the speaker 206. On the other hand, when the grill detection signal indicates that the grill is removed from the housing, then equalization settings B 214 can be utilized by the audio output circuit 204 in producing the output signals for the speaker 206.

Figure 2B:
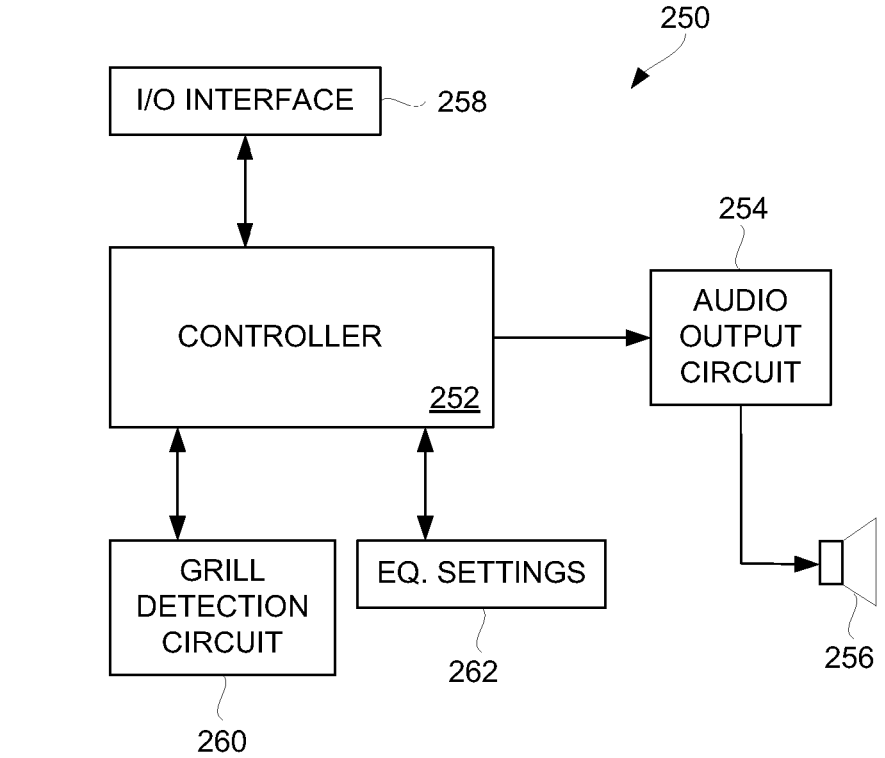
FIG. 2B is a block diagram of an audio delivery apparatus according to another embodiment of the invention.

FIG. 2B is a block diagram of an audio delivery apparatus 250 according to another embodiment of the invention. As an example, the audio delivery apparatus 250 can represent audio delivery circuitry within the media delivery apparatus 102 illustrated in FIG. 1.

The audio delivery apparatus 250 includes a controller 252, an audio output circuit 254 and a speaker 256. The controller 252 acquires media data that is processed to produce output audio data. The output audio data is supplied to the audio output circuit 254. The audio output circuit 254 then produces audio signals that are provided to the speaker 256 so that the appropriate audio sounds are produced. The controller 252 can, for example, receive the media data from an internal data storage device or from an input/output (I/O) interface 258. For example, the I/O interface 258 can permit connection to a media storage device, such as a removable data storage device, a portable media player or a network-based media storage device.

Once the controller 252 receives the media data that is to be output (i.e., played), the controller 252 can produce the audio output data. In doing so, the controller 252 can interact with a grill detection circuit 260. In particular, the grill detection circuit 260 provides a grill detection signal to the controller 252. The grill detection signal indicates whether a removable grill is attached or detached from the housing for the audio delivery apparatus 250. The controller 252 also has access to equalization settings 262. The controller 252 produces the audio output data for the audio output circuit 254 dependent upon not only the media data but also the appropriate equalization settings 262. The controller 252 determines the equalization settings 262 to be utilized, often from a plurality of different available sets, based at least in part on the grill detection signal provided by the grill detection circuit 260.

In one embodiment, the grill detection circuit 210, 260 includes at least a switch. In one embodiment, the removable grill can be attached to the housing through a plurality of posts provided on the removable grill. These mounting posts can be metal so as to act as a switch-closing element when the removable grill is attached to the housing. However, in general, the grill detection circuit 260 can use any of a wide range of different mechanical or optical switches.

Figure 3:
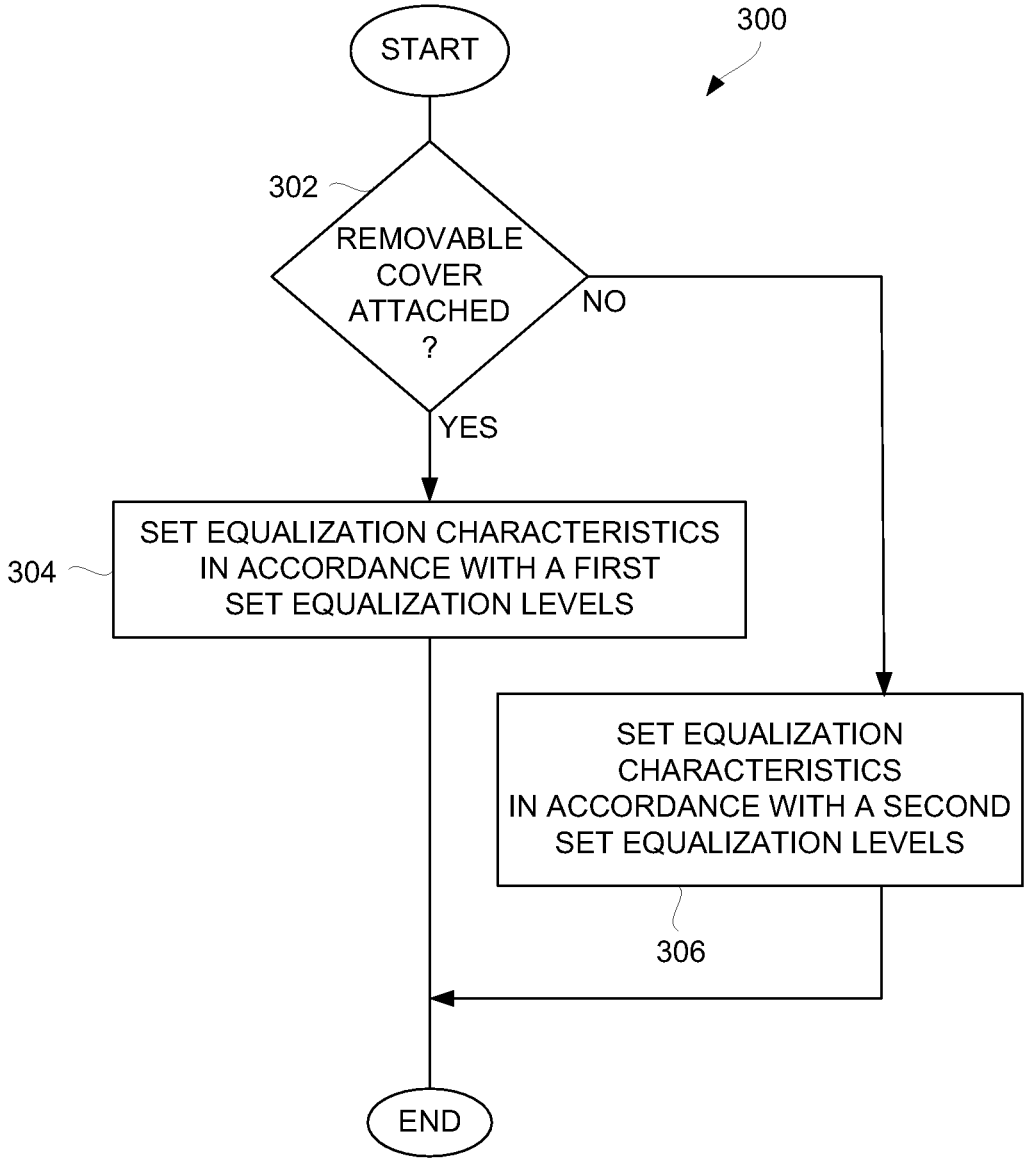
FIG. 3 is a flow diagram of an equalization adjustment process according to one embodiment of the invention.

FIG. 3 is a flow diagram of an equalization adjustment process 300 according to one embodiment of the invention. The equalization adjustment process 300 is, in general, performed by an audio delivery apparatus. For example, the equalization adjustment process 300 can be performed by the audio delivery apparatus 100 illustrate din FIG. 1 or the audio delivery apparatus 200 illustrated in FIG. 2A, or the audio delivery apparatus 250 illustrated in FIG. 2B.

The equalization adjustment process 300 includes a decision 302 that determines whether a removable cover is attached. For example, the audio delivery apparatus includes a removable cover. Hence, the decision 302 can determine whether or not the removable cover is attached. When the decision 302 determines that the removable cover is attached, equalization characteristics are set 304 in accordance with a first set of equalization levels. On the other hand, when the decision 302 determines that the removable cover is not attached, then equalization characteristics are set 306 in accordance with a second set of equalization levels. Accordingly, the equalization adjustment process 300 can utilize different equalization characteristics depending upon whether the removable cover is attached or not. In any case, following the blocks 304 and 306, the equalization adjustment process 300 is complete and ends.

Figure 4:
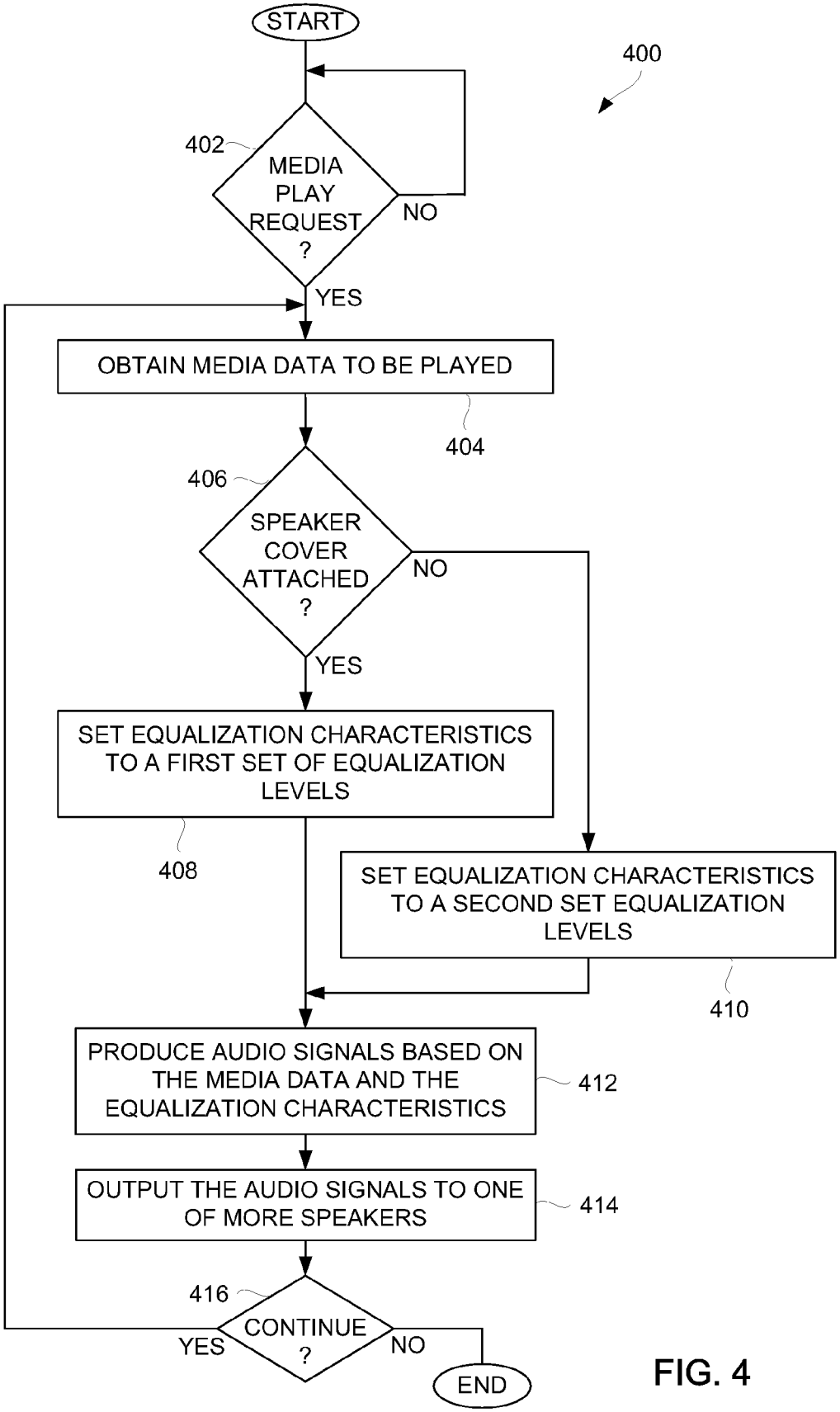
FIG. 4 is a flow diagram of an audio output modification process according to one embodiment of the invention.

FIG. 4 is a flow diagram of an audio output modification process 400 according to one embodiment of the invention. The audio output modification process is, for example, performed by an audio delivery apparatus.

The audio output modification process 400 begins with a decision 402. The decision 402 determines whether a media play request has been received. When the decision 402 determines that a media play request has not yet been received, the audio output modification process 400 awaits such a request. Once the decision 402 determines that a media play request has been received, the audio output modification process 400 continues. In other words, the audio output modification process 400 can be deemed invoked once a media play request is received.

After the media play request has been received, media data to be played is obtained 404. Next, a decision 406 determines whether a speaker cover is attached. Here, the audio delivery apparatus includes a removable speaker cover. The decision 406 determines whether the speaker cover is attached to the audio delivery apparatus or removed therefrom. When the decision 406 determines that the speaker cover is attached, equalization characteristics are set 408 to a first set of equalization levels. Alternatively, when the decision 406 determines that the speaker cover is not attached, equalization characteristics are set 410 to a second set of equalization levels. Accordingly, the audio output modification process 400 allows different equalization settings to be automatically utilized depending upon whether or not the speaker cover is attached.

Following the blocks 408 or 410, audio signals are produced 412 based on the media data and the equalization characteristics that have been set. The audio signals are then output 414 to one or more speakers. Thereafter, a decision 416 determines whether the audio output modification process 400 should continue. When the decision 416 determines that the audio output modification process 400 should continue, processing returns to repeat the block 404 and subsequent blocks. Alternatively, when the decision 416 determines that the audio output modification process 400 should not continue the audio output modification process 400 ends.

The invention pertains to improved techniques to attach a removable component to a media delivery apparatus. As discussed below, the removable component can, for example, be an access door for the media delivery apparatus or a speaker grill (or cover) for the media delivery device. The invention also pertains to an improved plug arrangement that makes use of a portion of the housing of the media delivery device.

Figure 5:
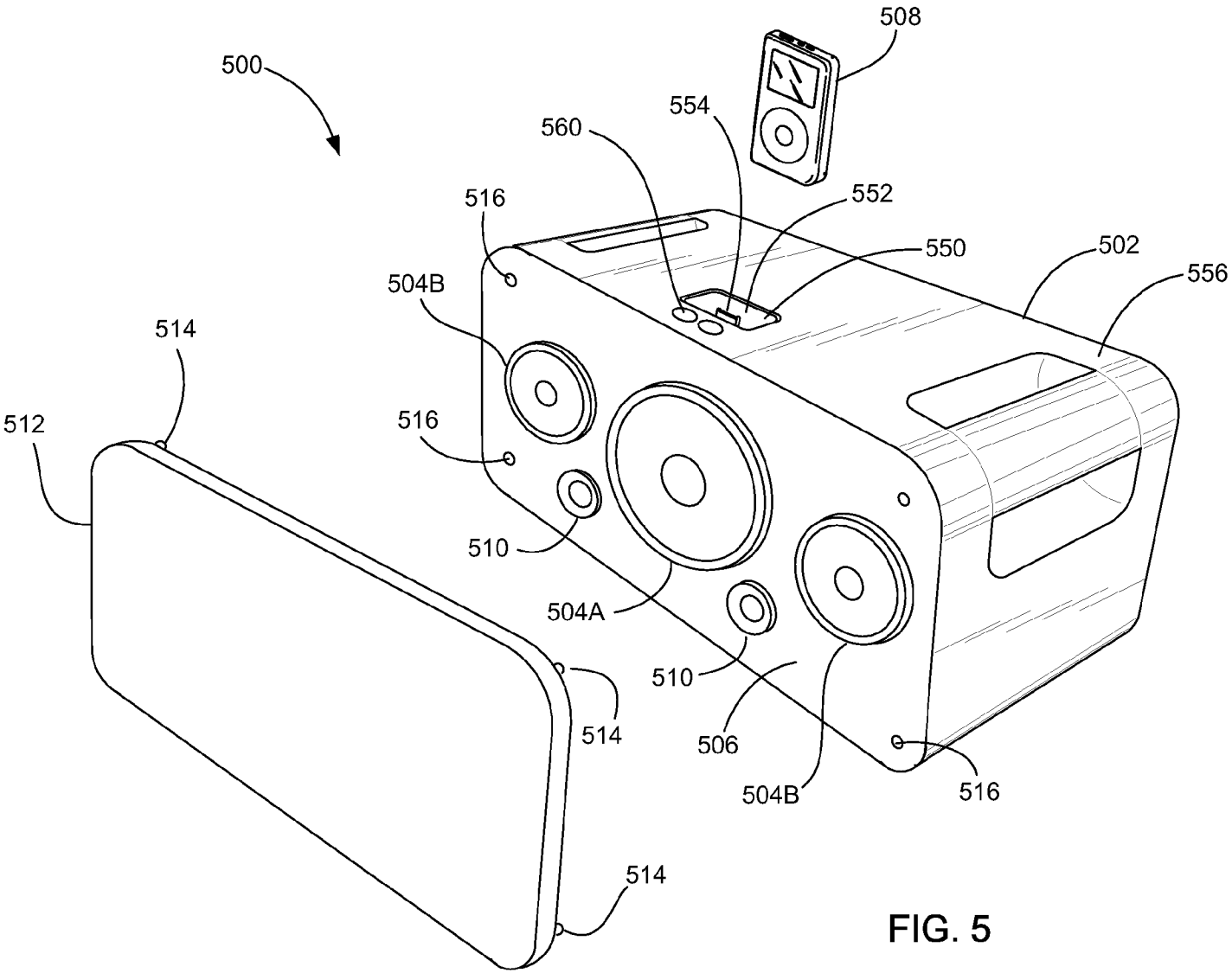
FIG. 5 is front perspective diagram of a sound system in accordance with one embodiment of the present invention.
Figure 6:
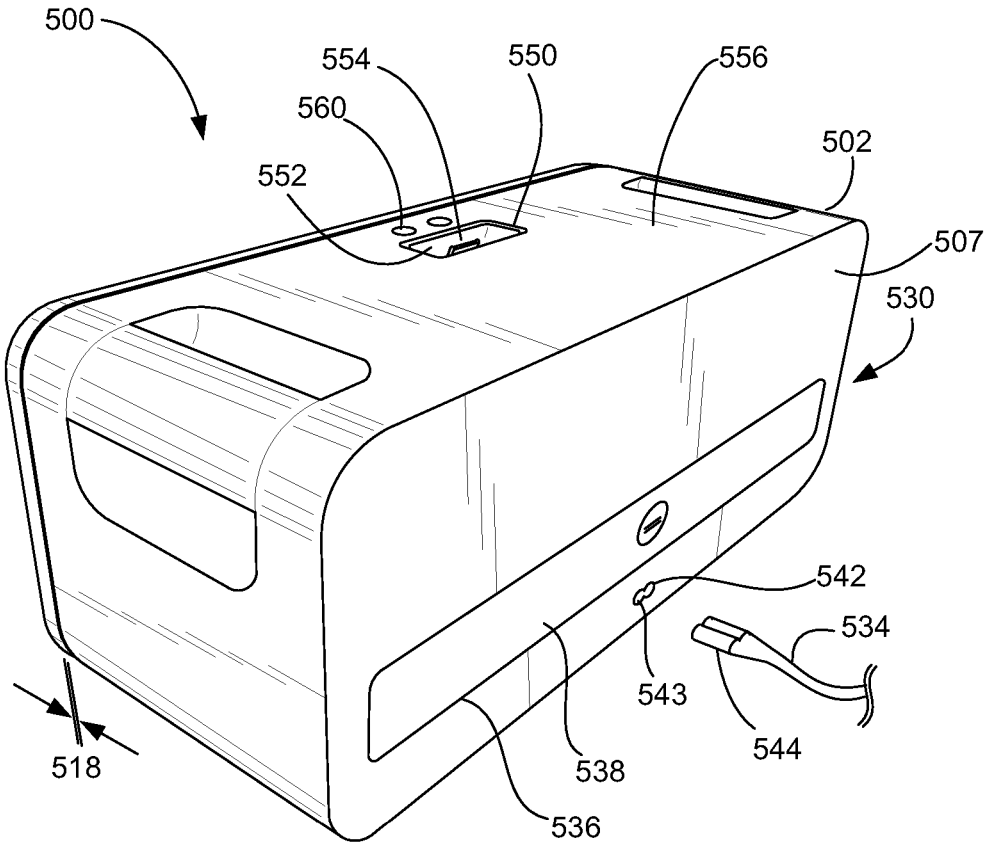
FIG. 6 is rear perspective diagram of a sound system in accordance with one embodiment of the present invention.

FIGS. 5 and 6 are perspective diagrams of a sound system 500, in accordance with one embodiment of the present invention. FIG. 5 is a front perspective view and FIG. 6 is a rear perspective view of the sound system 500. The sound system 500 is capable of playing recorded music at relatively high volume.

The sound system 500 includes a housing 502 and one or more speaker drivers 504 mounted to the housing 502. The speaker drivers 504 may for example be mounted to the front wall 506 of the housing 502. The speaker drivers 504 are configured to output sound based on audio signals generated via a media player 508 that is integrated with the sound system 500 or one that is removably coupled to the sound system 500 (as shown). The media player 508 may be a digital music player such as an MP3 player. By way of example, the media player may be a iPod® media player manufactured by Apple Inc., of Cupertino, Calif.

The type and number of speaker drivers 504 may be widely varied. In the illustrated embodiment, the sound system 500 includes a central sub woofer 504A and full range drivers 504B positioned at the sides of the subwoofer 504A. In order to further enhance the sound output, the sound system 500 may further include one or more ports 510 disposed in the front wall 506 along with the speaker drivers 504.

Besides acting like a speaker box, the housing 502 serves various functions including but not limited to surrounding internal components at a peripheral region thereof so as to cover and protect them from adverse conditions; structurally supporting the internal components in their assembled position within the housing 502; and defining the shape or form of the sound system 500.

Although not shown, the internal components may for example include processors, controllers, memory, electrical circuits, batteries, power supplies, amplifiers as well as other circuitry needed to operate the sound system 500. The various electrical components of the sound system 500 are powered by a power supply that draws energy from a battery or a power outlet. Amplifiers, in particular, are configured to increase or boost the level of an audio signal provided by a media player whether internal or external to the system (108). Generally speaking, the amplifier receives audio signals from the media player 508 and generates larger, more powerful audio signals.

The amplified audio signals are used to drive the one or more speaker drivers 504 mounted to the front of the housing 502. That is, the amplified audio signals move a speaker cone of the speaker drivers 504 back and forth thereby generating a physical sound wave.

In order to protect the speaker drivers 504 particularly the exposed speaker cones of the speaker drivers 504 (as well as the ports), the sound system 500 also includes a removable speaker grill 512 that is situated in front of the speaker drivers 504. Although not a requirement, in one embodiment, the speaker grill 512 includes a frame and a fabric cover that is attached around the frame. Alternatively, the speaker grill 512 may be embodied as a perforated metal or plastic cover. In one implementation, the speaker grill 512 has a shape that coincides with the shape of the front wall 506 of the housing 502 thereby improving the aesthetic appearance of the sound system 500. The speaker grill 512 also includes one or mounts 514 for coupling the speaker grill 512 to corresponding mounts 516 on the front of the housing 502. In most cases, the mounts 514/516 allow the speaker grill 512 to be easily removed from the housing 502. For example, the mounts 514/516 may be embodied as snap fittings or friction couplings or magnetic couplings, etc.

In one embodiment, unlike conventional speaker mounts, the speaker mounts 514/516 of the present invention are configured to limit the gap 518 found between the edges of the speaker grill 512 and the front wall 506 of the housing 502 to further improve the aesthetic appearance of the sound system 500 as well as to better protect the speaker cones of the speaker drivers 504. The gap is small yet adequate to isolate the speaker grill 512 from the front wall 506 of the housing 502. By way of example, according to one embodiment of the invention, the gap 518 may be between about 1-6 mm and more particularly about 2 mm. In order to maintain a small gap, the speaker grill 512 may provide a space, void or recess on its inside surface for receiving the protruding speaker drivers 504. When the speaker grill is attached using the mounts 514/516, the speaker drivers 504 are seated within this space thereby forming the small gap. By way of example, the outer frame of the speaker grill that surrounds the speaker drivers may have a depth larger than the depth of the protruding speaker drivers.

Although this arrangement improves the aesthetic appearance and helps protect the speaker drivers 504, it may generate undesired noise, such as vibrations or chatter, between the speaker grill 512 and the front wall 506 when the speaker drivers 504 are operating. The sound waves generated by the speaker drivers 504 cause the speaker grill 512 to vibrate. Because of the small gap 518 between the speaker grill 512 and housing 502, the vibrating speaker grill 512 intermittingly comes into contact with the housing 502 thereby creating chatter, which can degrade the listening experience. Therefore, in accordance with one embodiment, the speaker grill 512 further includes a dampening mechanism for preventing the chatter. In one embodiment, the dampening mechanism may, for example, be deformable bumpers or gaskets that are positioned between the inside surface of the speaker grill 512 and the outside surface of the front wall 506 along the perimeter of their interface (e.g., edge). In one implementation, the deformable bumpers or gaskets fill the gap between the speaker grill and housing (at least at certain portions of the gap) thereby dampening the vibration. In one implementation, the bumpers or gaskets are placed at the locations of the mounts 514/116.

The sound system 500 also includes a power arrangement 530 for powering the sound system 500. The power arrangement 530 typically includes one or more internal batteries and/or an external power cord 534 that plugs into a power outlet in order to provide power to the sound system 500. The power may be used to drive the various components of the sound system 500 including for example the amplifier. The power may also be used to recharge or provide power to the media player 508 operatively coupled to the sound system 500.

In one embodiment, the sound system 500 includes a battery compartment 536 including a battery cavity for placement of one or more batteries such as alkaline or lithium-ion batteries, and an access door 538 that covers and seals the battery cavity 536. The access door 538 when removed allows the user access to the battery cavity 536 so that batteries can be removed and replaced. In one implementation, the battery cavity 536 is configured to receive a plurality of "D" sized batteries. For example, the cavity 536 may be configured for 6 "D" sized batteries. The access door 538 when inserted acts like part of the housing 502. For example, it may be flush with the back housing wall 507. In most cases, the access door 538 includes a locking feature 540 for securing the access door 538 to the housing 502 in front of the battery cavity 536.

In one embodiment, in order to maintain a clean continuous appearance at the housing wall 507 (as well as to better seal the housing), a power plug 542 for receiving a cord connector 544 of the power cord 534 is formed by a portion of the housing 502. That is, rather than using inserts which form gaps and lines at the power plug 542, the housing 502 itself forms a part of the power plug 542 thereby maintaining a clean continuous look and eliminating gaps. Not only does this provide a better appearance, but it is also believed to prevent contaminants and provide better sound quality. In this embodiment, the power plug 542 includes an internal fixture (not shown in FIGS. 5 and 6) that is attached inside the housing 502 behind an opening 543 in the housing wall 507. The opening 543 in the housing wall 507 is sized and dimension to match the cord connector 544 so that the cord connector 544 can interface with the internal fixture disposed therein.

The sound system 500 may also include an integrated docking station 550 for allowing the media player 508 to interact with the sound system 500. When inserted in the docking station 550, the functionality of a media player 508 becomes available for use by the sound system 500 (or vice versa). The media player 508 essentially becomes a part of the sound system 500 when placed in the docking station 550. When the media player 508 is taken out, it becomes a separate device again.

As shown, the integrated docking station 550 includes a media bay 552 capable of physically receiving the media player 508 and a connector arrangement 554 disposed within the media bay 552 for operatively coupling the media player 508 to the operational components of the sound system 500. The media bay 552 is integrated or part of the housing 502 so that media player 508 can be easily be inserted into or removed from the media bay 552. In one embodiment, the media bay 552 is integral with the top wall 556 of the housing 502. That is, the media bay 552 is formed into the top wall 556. In most cases, the user interface of the media player 508 is completely exposed to the user so that it is accessible to a user while inserted in the media bay 552. In some cases, the user interface of the media player 508 may act as the primary user interface of the sound system 500 and in other cases, the user interface may be secondary to a user interface of the sound system 500.

In one embodiment, the media bay 552 is configured to have a size and shape that coincides with the size and shape of the media player 508 so that the media player 508 can rest snugly within the media bay 552. That is, the inner peripheral surfaces of the media bay 552 are sized to receive the outer peripheral surfaces of the media player 508 (allowing for some tolerances). By way of example, the media bay 552 may be configured to receive the back end of the media player 508. Alternatively, the media bay 552 may be configured to receive a bottom end of the media player 508 (as shown). In either case, the connector on the media player 508 is configured to connect with the connector on the docking station 550 when the media player 508 is inserted in the media bay 552.

In another embodiment, the docking station 550 may include a plurality of removable spacers or inserts (not shown) that can change the size and shape of the media bay 552 thereby accommodating more than one media player. This is especially beneficial when supporting various media players that come in different sizes and shapes. In this embodiment, the media bay 552 is configured to receive all the various inserts, and each of the inserts has a slot or opening that accommodates a particular media player.

In another embodiment, the docking station 550 may be a universal docking station capable of receiving media players that come in different sizes and shapes. In this embodiment, the docking station 550 includes one or more adjustable members that have the ability to change the dimensions (size and/or shape) of the media bay 552 in order to accommodate more than one media player 508. Generally speaking, the adjustable members expand the media bay 552 outwardly to accommodate larger media devices 508 and retract the media bay 552 inwardly to accommodate smaller media devices 508. By way of example, the docking station 550 may include at least one sliding member that slides within the media bay 552 between a retracted position that forms a large opening in the media bay 552 for receiving larger handheld media players 508, and an expanded position that forms a small opening in the media bay 552 for receiving smaller media players 508.

In one implementation of this embodiment, the docking station includes a sliding blade on each side of the media bay. The sliding blades slide towards the center of the media bay to change its shape and size. The sliding blades may move together, or separately depending on the needs of the docking station. In one example, the movement of the blades are connected such that they move together in and out of the media bay. The blades may for example have a trapezoidal shape such that their edges come into contact at the minimum sized opening in the media bay. In one implementation, the movement of the blades may be automatic. For example, the docking station may sense the presence of the media player and thereafter drive the blades to close until they abut the surfaces of the media player. This may, for example, be accomplished through a motor and cams, gears or cables that drive the blades together.

In another embodiment, the docking station may include a rotatable platform that contains the media connector. In this embodiment, instead of having a connector disposed within a media bay, the connector rotates on a platform from a position within the docking station where it is hidden from view and protected from damage to a position outside the docking station so that a media player can be connected thereto. The connector protrudes away from one of the sides of the platform. The platform generally rotates within a void that is similar to the media bay. The depth of the void has a depth and shape that allows the platform including the connector to fully rotate through 360 degrees or alternatively between 0 and 180 degrees. That is, the void is dimensioned to allow the platform/connector to rotate therein without impediments. Furthermore, in order to help seal the void and reduce gaps, the platform may have an outer perimeter that substantially matches the inner perimeter of the opening in the void. Moreover, the top and bottom surfaces of the platform may be configured to be flush with the outer surface of the docking station when it is in the 0 or 180 degree positions. In one implementation, the platform is attached to the sides of the void via a pair of pivots, and connector arrangement of the docking station is seated on one side of the platform. The connector arrangement can therefore be hidden from view when the platform is turned over. In this implementation, the connector arrangement may be electrically connected to other electrical components through wires or flex circuits that run through the pivots.

Additional information on docking stations that can be integrated into the media delivery system or sound system may be found in U.S. application Ser. No. 10/423,490, filed Apr. 25, 2003 entitled "MEDIA PLAYER SYSTEM", which is hereby incorporated herein by reference; U.S. application Ser. No. 11/125,883 filed May 9, 2005 entitled "UNIVERSAL DOCKING STATION FOR HAND HELD ELECTRONIC DEVICES", which is hereby incorporated herein by reference; and U.S. application Ser. No. 11/212,302 filed Aug. 24, 2005 entitled "DOCKING STATION FOR HAND HELD ELECTRONIC DEVICES", which is herein incorporated by reference.

The sound system 500 may include one or more buttons 560 for controlling the media player 508 when the media player 508 is placed in the docking station 552. The functionality of the buttons 560 may be widely varied and may include one or more controls for us with the sound system 500 or the media player 508. In the illustrated embodiment, for example, the sound system 500 includes a pair of buttons for increasing and decreasing the volume being outputted by the sound system 500. In order to maintain a continuous surface and prevent lines and breaks in the housing wall 556, the buttons 560 may be capacitive buttons.

Alternatively or additionally, a remote control (not shown) having the controls necessary to control the media player 508 may be provided. The remote control may interact with the sound system using known wireless interfaces. In one example, the wireless interface is based on infrared (IR) communications. In cases such as these, the front wall may include an optical IR sensing device for receiving instructions from the remote control. The optical IR sensing device may for example be placed behind the fabric portion of the speaker grill 512. Addition information on remote controls that can be used may be found in U.S. patent application Ser. No. 11/245,937, filed Oct. 7, 2005, entitled "TECHNIQUES FOR PAIRING REMOTE CONTROLLERS WITH HOST DEVICES", which is herein incorporated by reference.

According to another aspect of the invention, an access door for a sound system is provided. The access door is easily removable and typically includes a quick release coupling. The access door is further configured to maintain the contour of the sound system (e.g., flush with the housing of the sound system). In some cases, the access door may be further configured to help seal an interface with the housing in order to provide better sound quality.

Figure 7A:
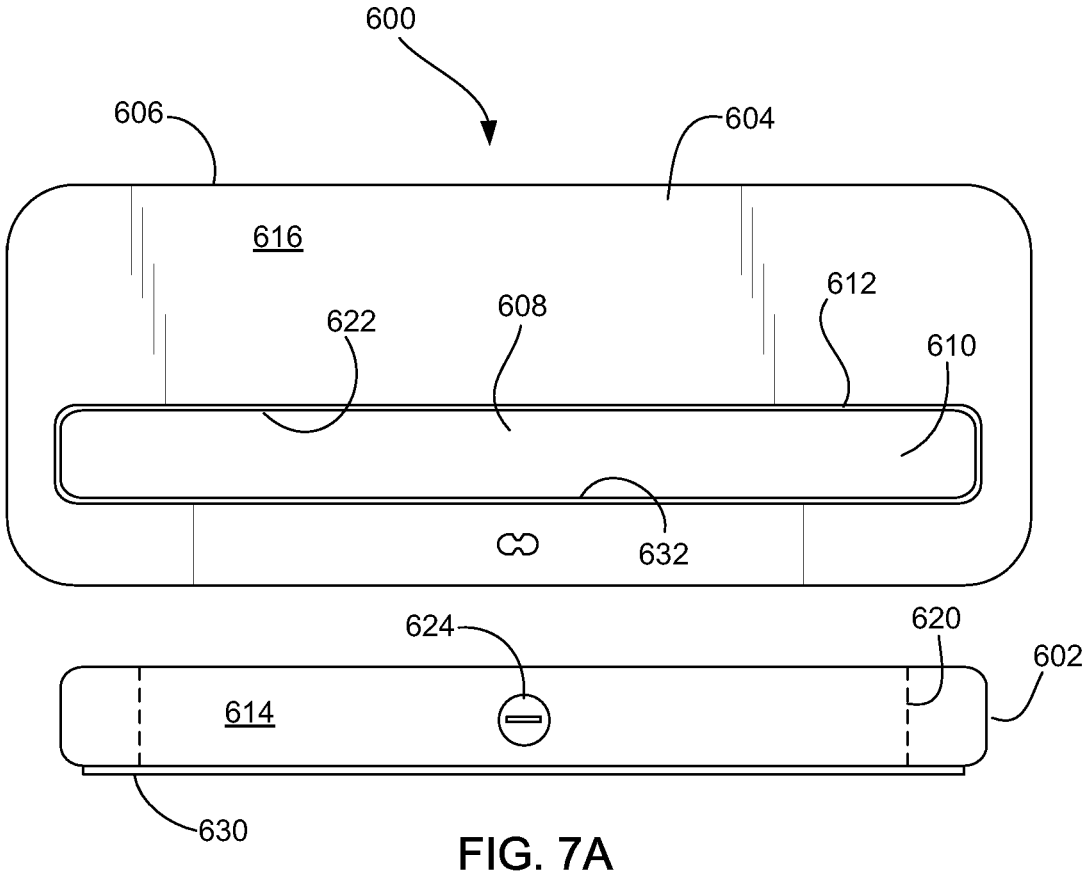
FIGS. 7A and 7B illustrate a sound system with a removable access door in accordance with one embodiment of the present invention.
Figure 7B:
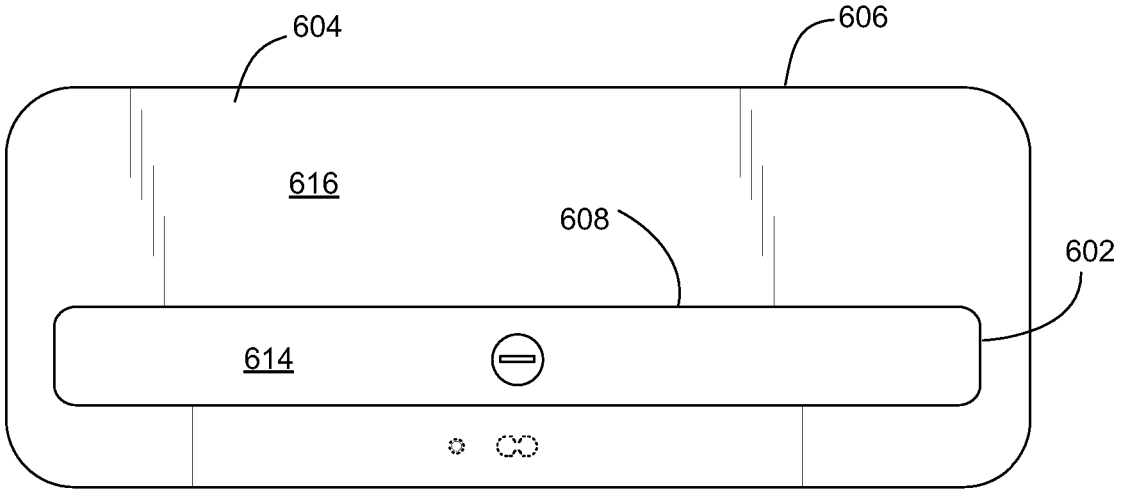

FIGS. 7A and 7B illustrate a sound system 600 with a removable access door 602 in accordance with one embodiment of the present invention. The sound system 600 may, for example correspond to the sound system 500 illustrated in FIG. 5. Although the access door 602 can be placed anywhere on the sound system 600, in the illustrated embodiment, the access door 602 is situated at the back wall 604 of the housing 606 of the sound system 600.

The removable access door 602 is configured to fit within an opening 608 in the back wall 604 of the housing 606. The shape of the access door 602 typically coincides with the shape of the opening 608 in order to provide a tight fit (may include some tolerances). The opening 608 may, for example, be an opening associated with a compartment 610 located inside the housing 606. In one embodiment, the compartment 610 is a battery compartment.

Although not a requirement, the opening 608 may include a cutout or recessed portion 612 around its perimeter for receiving the back side of the removable access door 602 (e.g., abutment stop). The recessed portion 612 provides a mating interface for the access door 602 relative to the housing 606. It may also provide a better seal between the door and the housing. In most cases, the recessed portion 612 is designed to place the outer surface 614 of the access door 602 substantially flush with the outer surface 616 of the back wall 604 of the housing 606 adjacent the access door 602 when the access door 602 is disposed within the opening 608 and abutting the recessed portion 612 (e.g., the depth of the recess is equal to the thickness of the access door at its perimeter). This is typically done to provide a clean and continuous appearance that is aesthetically pleasing to the user. In one embodiment, the outer surface 614 of the access door 602 is substantially planar (flat) in order to coincide with the planar contour of the back wall 604 of the housing 606. The recessed portion 612 can also include or support a gasket to provide an improved acoustic seal when the access door 602 is attached to the back wall 604 of the housing 606.

The access door 602 generally includes a locking mechanism for securing the access door 602 to the housing 606 when it is desired to be closed and for releasing the access door 602 from the housing 606 when it is desired to be opened. The locking mechanism generally consists of two parts, a housing-side locking mechanism and a door side locking mechanism. These two mechanisms are cooperatively positioned so that when the access door 602 is closed, the locking mechanisms are capable of lockably engaging with one another thus securing the access door 602 to the housing 606. The locking mechanism also includes a quick release locking feature that enables a user to easily and quickly lock and unlock the door side locking mechanism relative to the housing-side locking mechanism (or vice versa) thereby securing or releasing the access door 602 from the housing 606 in a simple and easy manner.

Referring to FIG. 7A, one embodiment of a locking mechanism will be described. The locking mechanism includes a sliding retention bar 620 that slides out of the top of the access door 602 in order to mate with a top slot (or recess) 622 located within the opening 608 of the housing 606. The retention bar 620 is configured to engage the slot 622 to hold the access door 602 in place. The retention bar 620 is slidable between an engagement position, moving the retention bar 620 within the slot 622, and a disengagement position, decoupling the retention bar 620 from the slot 622. When engaged, the retention bar 620 is captured within the slot 622 and therefore the access door 602 is secured to the housing 606. When disengaged, the retention bar 620 is released from the slot 622 and therefore the access door 602 can be removed from the housing 606. The locking mechanism may further include a rotatable locking feature 624 for driving the retention bar 620 between the engagement and disengagement positions. The rotatable locking feature 624 is generally designed for ease of use and one-handed operation. In one example, the rotatable locking feature 624 is a flat circular insert that is flush with the outer surface of the access door 602 and that includes a channel for manipulating it between an open and closed position.

The locking mechanism may further include a fixed retention lip 630 located at the bottom of the access door 602 that mates with a bottom slot or recess 632 located within the opening 608 of the housing 606. The slot 632 receives the retention lip 630 so as to help secure the access door 602 to the housing 606 as well as to coarsely position the access door 602 relative to the housing 606. As should be appreciated, the retention bar 620 and the slot 622 typically need to be aligned in order for them to properly engage one another.

Although the slots 622 and 632 can be placed at any depth within the opening 608, they are typically located at a position that places the outer surface 614 of the access door 602 flush with the outer surface 616 of the housing 606.

In order to connect the access door 602 to the housing 606, a user places the retention lip 630 within the slot 632 and rotates the access door 602 about this interface. At the end of the rotation, the access door 602 is placed within the opening 608 and the back side of the access door 602 is placed against the recessed portion 612. Furthermore, the retention bar 620 is positioned adjacent the slot 622 (e.g., disengagement position).

In order to secure the access door 602 to the housing 606, the user rotates the locking feature 624. The rotating action causes the retention bar 620 to slide into the slot 622 (e.g., engagement position). Although not shown in this Figure, the locking mechanism generally includes some means for transforming rotating motion of the locking feature 624 into linear motion of the retention bar 622. When the retention bar 620 is captured within the slot 622, the access door 602 is held relative to the housing 606.

In some cases, it may be necessary to provide a means for forcing the access door 602 tight against the recessed portion 612 in order to seal the interface there between. In cases such as this, the retention bar 620 and/or the slot 622 may include a tapered portion or ramp that causes the access door 602 to move towards the recessed portion 612 as the retention bar 620 slide into the slot 622. The tapered portion in essence causes the access door 602 to be sucked into the opening 608 against the recessed portion 612.

In order to remove the access door 602 from the housing 606, a user simply performs the operations in reverse. For example, the user rotates the locking feature 624 back to its unlocked position in order to slide the retention bar 620 from the engagement position to the disengagement position. When in the disengagement position, the retention bar 620 is decoupled from the slot 622 and therefore the access door 602 is no longer secured to the housing 606. Thereafter, the user rotates the access door 602 away from the housing 606 about the retention lip/slot interface. Once the access door 602 is free from the opening 608, the user may simple lift up on the access door 602 to release the retention lip 630 from the slot 632. Once released, the access door 602 is fully removed from the housing 606.

Figure 8:
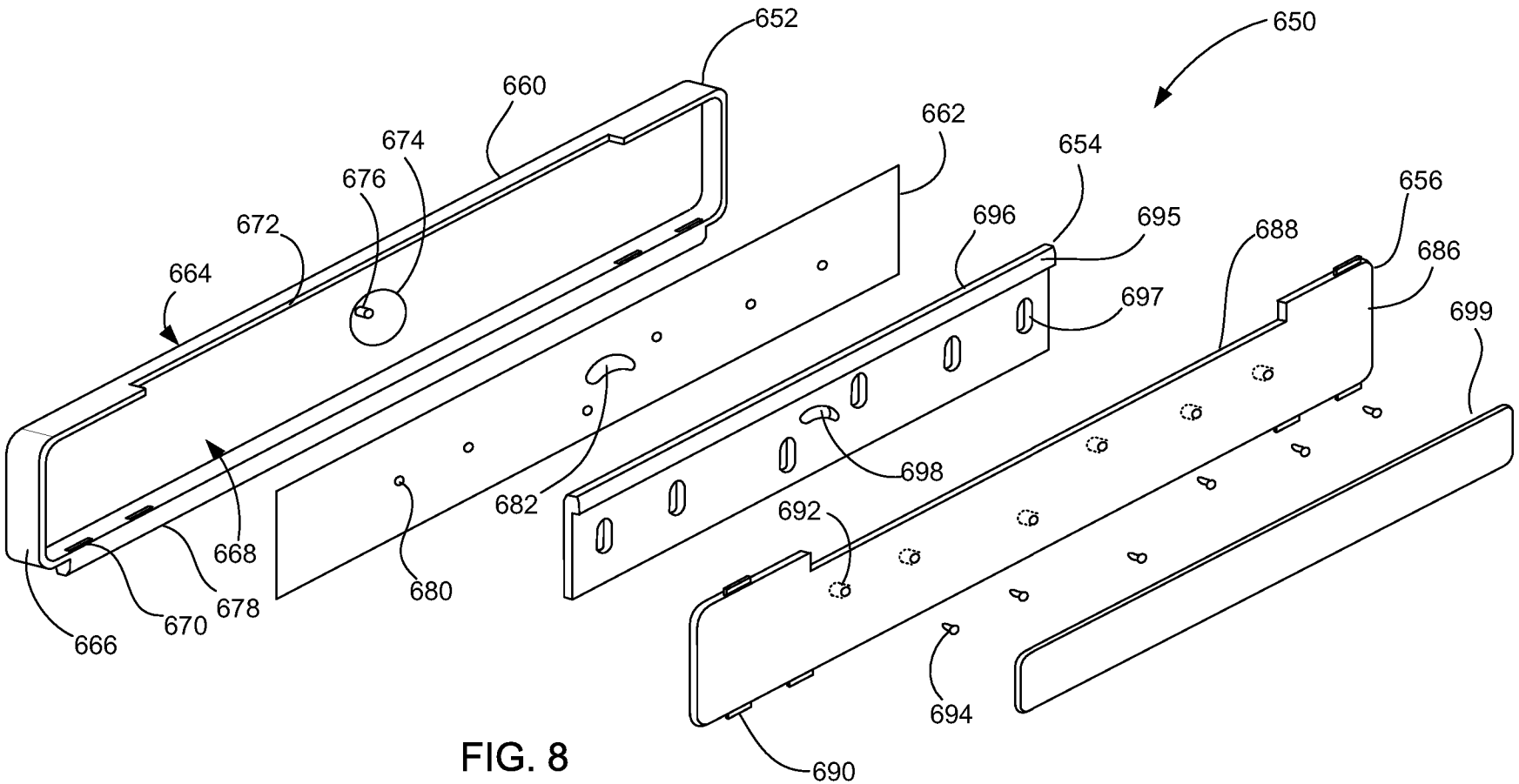
FIG. 8 is an exploded perspective view diagram of a removable access door in accordance with one embodiment of the present invention.

FIG. 8 is an exploded perspective view diagram of a removable access door 650 in accordance with one embodiment of the present invention. The removable access door 650 may, for example, correspond to the removable access door 602 shown in FIGS. 7A and 7B.

The access door 650 includes an outer shell 652, sliding retention bar 654, and inner shell 656. The outer shell 652 and inner shell 656 are attached to one another thereby forming the peripheral outer surface of the access door 650. The outer and inner shell 652 and 656 slidably retain the sliding retention bar 654 therein when attached together. The sliding retention bar 654 slides through an opening formed between the top edges of the outer and inner shells 652 and 656.

Referring to the outer shell 652, the outer shell 652 includes a body 660 and a stiffening plate 662 attached to the body 660. The stiffening plate 662 may, for example, be adhered to the body 660 in order to stiffen the outer shell 652 (e.g., prevent flexing, bending and torsion). The body 660 includes a front wall 664 and a plurality of side walls 666 that form a pocket 668. A plurality of slots 670 are provided along the side walls 666. The top wall 666 further includes a recess 672 for slidably receiving the retention bar 654. The front wall 664 includes a rotating disk 674 recessed therein. The rotating disk 674 includes a post 676 that extends away from the back side of the disk 674. The body 660 also includes a retention lip 678 extending from the bottom wall 666. The stiffening plate 662 includes a plurality of threads 680 and a channel 682 in which the post 676 of the rotatable disk 674 rotates. The ends of the channel 682 serve as abutment stops for the post 676 (e.g., define the two positions of the lock). When adhered, the stiffening plate 662 helps retain the rotatable disk 674 (e.g., the rotatable lock is trapped between the front wall and the stiffening plate).

Referring to the inner shell 656, the inner shell 656 includes a body 686. The body 686 is in the form of a plate and is dimensioned to fit within the pocket 668 between the various side walls 666 (e.g., has an outer perimeter that matches the inner perimeter of the side walls). The top edge of the body 686 includes a recess 688. A plurality of tabs 690 are provided along the edges of the body 686. The tabs 690 are configured to snap into the slots 670 of the first body 660 thereby helping retain the inner shell 656 to the outer shell 652. The body 686 also includes a plurality of posts 692 with through holes disposed therein. The posts 692, and more particular the through holes align with threads 680 of the stiffening plate 662 when the inner shell 656 is placed within the outer shell 652. Screws 694 are provided to attached the inner shell 656 to the outer shell 652, i.e., the screws 694 are inserted through the posts 692 and threaded to the threads 680 of the stiffening plate 662. The posts 692 serve to provide standoffs for providing the internal volume needed for the sliding retention plate 654. The posts 692 also serves as guides along which the retention plate 654 slides when moving in and out of the access door 650.

Referring to the sliding retention plate 654, the sliding retention plate 654 includes a top portion 695 that is seated within the opening formed by the recesses 672/688 of the inner and outer shells 652 and 656. The top portion 695 includes a tapered edge 696 for helping guide the plate 654 into a slot within a housing. The retention plate 654 also includes a plurality of channels 697. When the inner shell 652 is attached to the outer shell 656, the posts 692 of the inner shell 656 are disposed within the channels 697. The retention plate 654 therefore is slidably retained between the inner and outer shells 652 and 656. The posts 692 guide the retention plate 654 linearly up and down. The retention plate 654 also includes a cam groove 698 that receives the post 676 of the rotating disk 674. When the rotating disk 674 is rotated, the post 676 slides within the cam groove 698 and drives the retention plate 654 up and down via a cam action (e.g., the post pushes upwards and downwards on the retention plate depending on the direction of rotation).

The access door 650 may further include a pad 699 that is connected to the inner shell 652. The pad 699 serves to cover the heads of the screws 694 as well as to provide a spring force on any components disposed on the inside of the access door. That is, when the access door is positioned within an opening in a housing, the pad 699 pushes against a component such as a battery thus helping retain the component in its desired position inside the housing.

According to another aspect of the invention pertains to a mounting arrangement for detachably connecting a speaker grill to a housing of a sound system. The mounting arrangement holds the speaker grill in place relative to the housing, helps align the speaker grill to the housing, and provides a controlled minimum gap between the speaker grill and the housing along there edges.

Figure 9A:
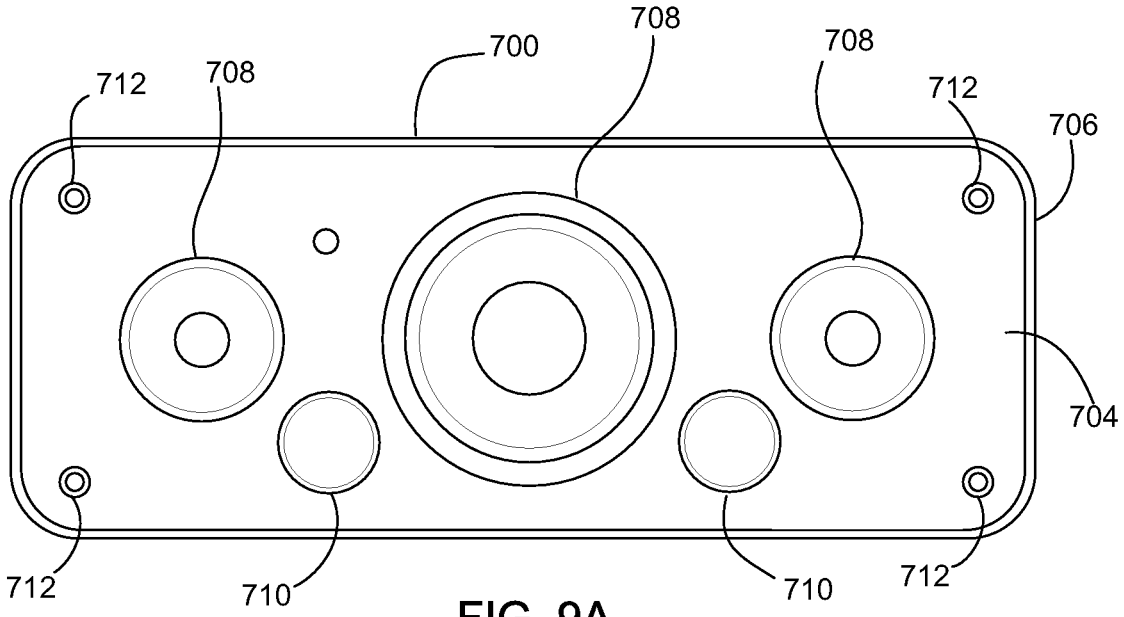
FIGS. 9A and 9B illustrate a sound system with a removable speaker grill in accordance with one embodiment of the present invention.
Figure 9B:
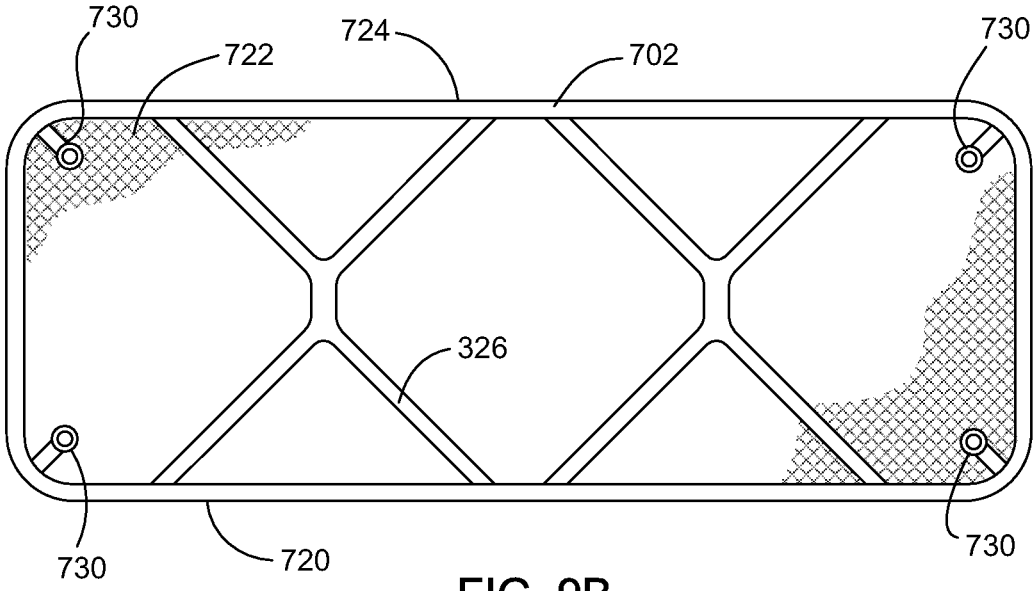

FIGS. 9A and 9B are diagrams of a sound system 700 with a removable speaker grill 702 in accordance with one embodiment of the present invention. FIG. 9A illustrates a front surface of the sound system 700. FIG. 9B illustrates an inside view of the removable speaker grill 702 while detached from the front surface of the sound system 700. The sound system 700 may, for example, correspond to the sound system 500 illustrated in FIG. 5. The removable speaker grill 702 is typically positioned over a housing wall 704 of a housing 706 of the sound system 700.

As shown in FIG. 9A, the housing wall 704 supports a plurality of speaker drivers 708 and ports 710. In particular, three speakers 708 and two ports 710. The front wall also includes a plurality of housing-side speaker mounts 712 located at the corners of the housing wall 704.

As shown in FIG. 9B, the speaker grill 702 includes a frame 720 with a fabric 722 stretched around it. The frame 720 includes an outer frame member 724 as well as internal frame member 726 disposed within the outer frame member 724. The outer frame member 724 typically has an outer perimeter that matches the outer perimeter of the housing wall 704 (e.g., they have the same shape). The internal frame member 726 helps support the outer frame member 724 and is located in between the speaker drivers 708 so as not to degrade the sound being outputted by the speaker drivers 708. The frame 720 also includes a plurality of grill-side speaker mounts 730 located at the corners of the speaker grill 702. The grill-side speaker mounts 730 are located at a position that coincides with the position of the housing-side speaker mounts 712 on the housing wall 704. The grill-side speaker mounts 730 are configured to engage the housing-side speaker mounts 712 in order to hold the speaker grill 702 in position relative to the housing wall 704. For example, to provide a small gap between the speaker grill 702 and the housing wall 704 as well as to align the edges of the speaker grill 702 with the edges of the housing wall 704.

In one embodiment, the interface between the housing-side mounts 712 and the grill-side mounts 730 are designed to provide limited holding power. For example, enough holding power to secure the speaker grill 702 to the housing 706, while still allowing a user to overcome the holding power when attaching and detaching the speaker grill 702 to and from the housing 706. One advantage of this type of interface is that the speaker grill 702 can be attached and detached with relative ease.

In one implementation, the housing-side speaker mounts 712 include a receptacle and a holding detent mechanism within the receptacle, and the grill-side speaker mounts 730 include a post that is inserted into the receptacle and held in the receptacle by the holding detent mechanism. When the post is inserted into the receptacle, the post is captured by the holding detent mechanism thereby securing the post within the receptacle and therefore the speaker grill 702 to the housing wall 704. When the post is removed from the receptacle, the post is released by the holding detent mechanism thereby freeing the post from the receptacle and therefore the speaker grill 702 from the housing wall 704.

To elaborate, the holding detect mechanism may include one or more holding flexures, and the post may include a recess. The holding flexures are biased inwards towards the centerline of the receptacle such that they extend into the receptacle. When the post is pushed into the receptacle, the post engages the holding flexures. Because the flexures flex, the flexures bend outwards away from the centerline of the receptacle when the end of the post is slid through the holding flexures. Upon further insertion, the holding flexures resume their natural position (bend back towards the centerline) within the recess thereby trapping the flexures within the recess. Using this arrangement, the post is prevented from sliding out of the receptacle on its own. In order to remove the post, a user simply pulls on the post. During the pulling action, the holding flexures flex around the post such that the flexures again bend outward thereby releasing the post from the receptacle. Using this arrangement, the user simply has to overcome the bias at the detent/recess interface when attaching or detaching the speaker grill 702.

Figure 10:
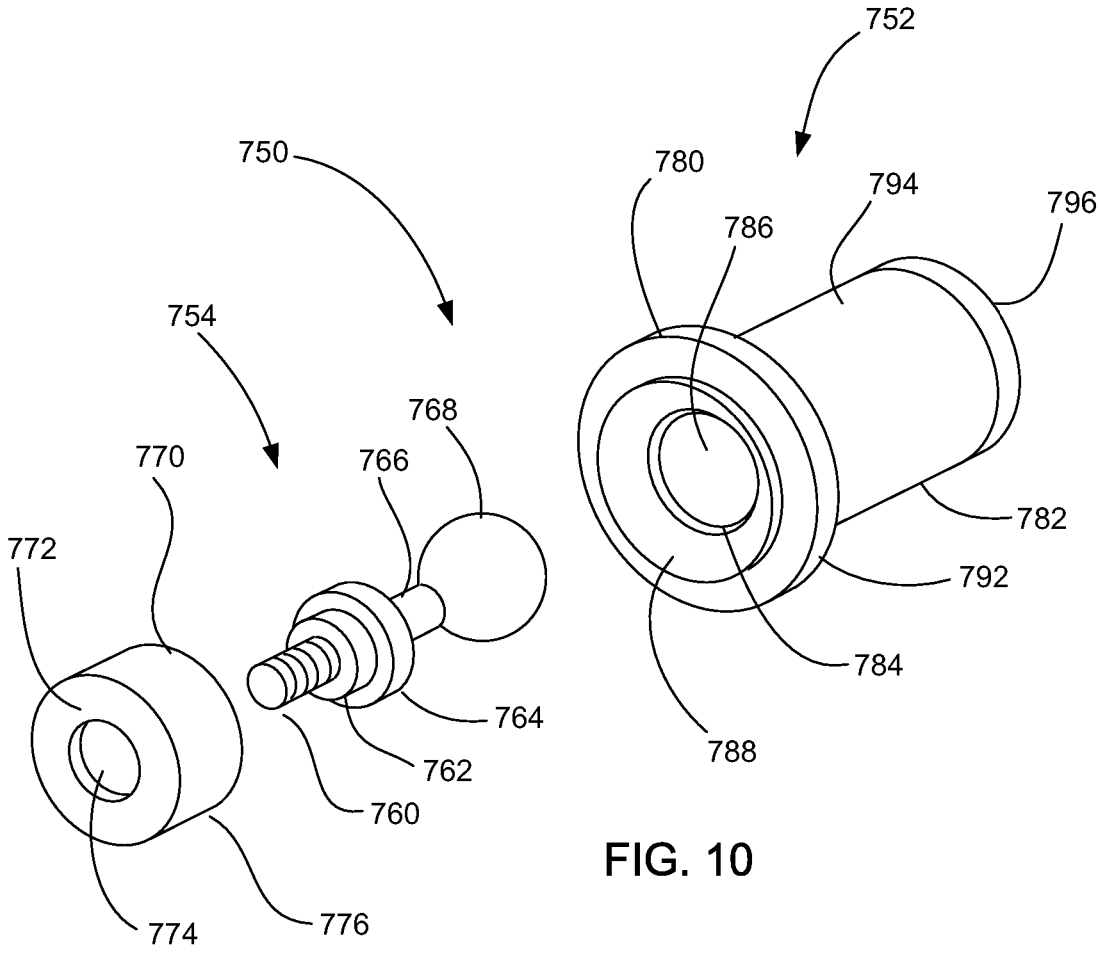
FIG. 10 is a perspective view of the mounting arrangement in accordance with one embodiment of the present invention.
Figure 11A:
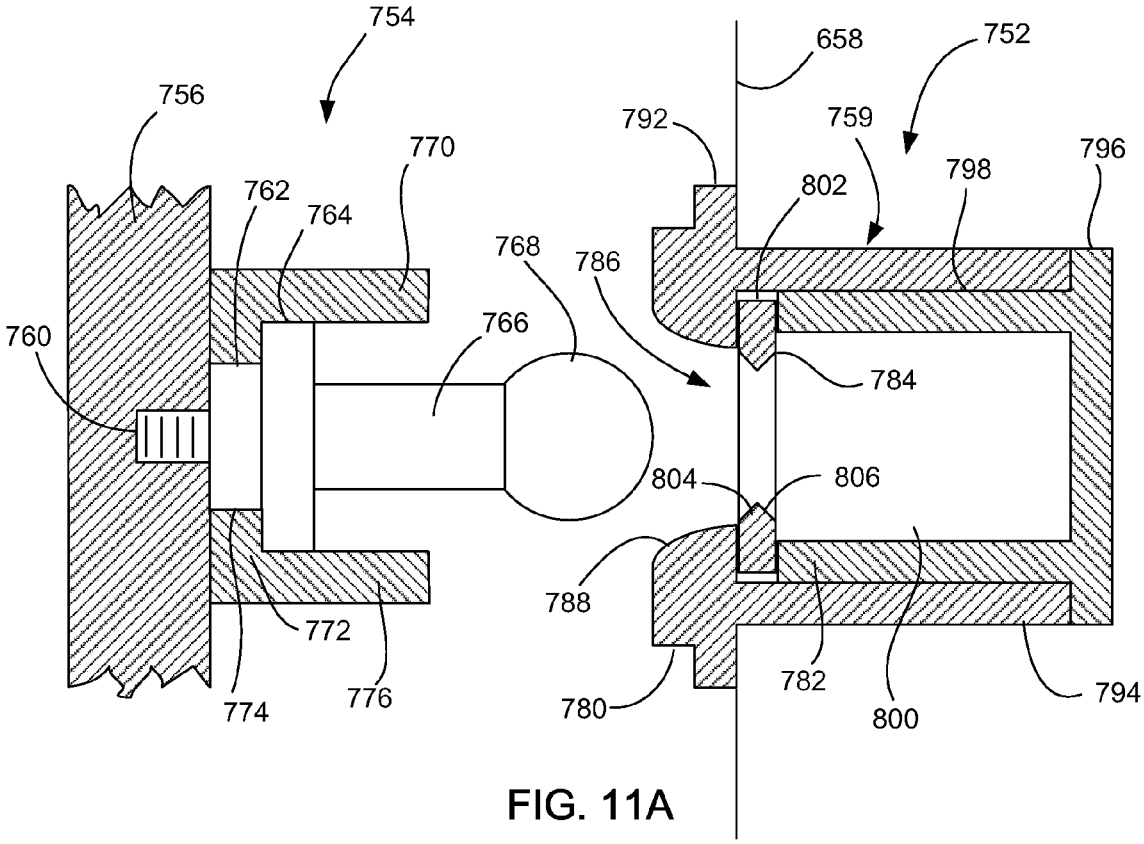
FIG. 11A is a side elevation view, in cross section, showing a grill-side mount disengaged from a housing-side mount in accordance with one embodiment of the present invention.
Figure 11B:
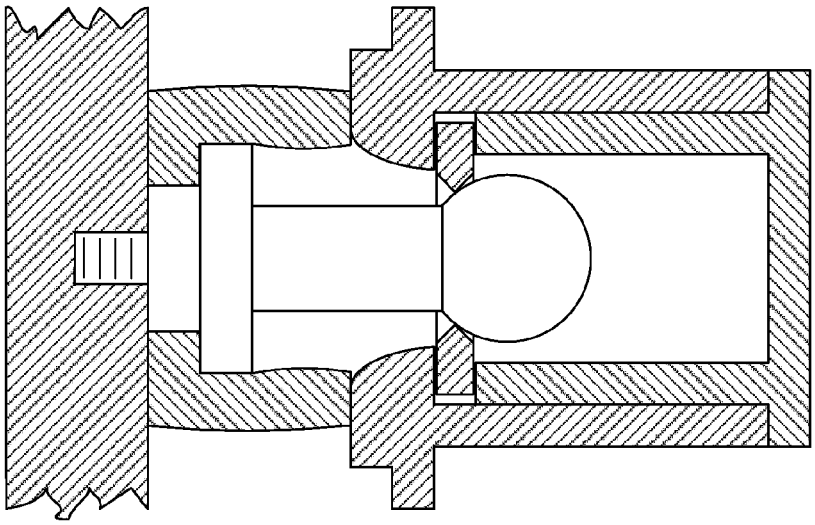
FIG. 11B is a side elevation view, in cross section, showing a grill-side mount engaged with the housing-side mount in accordance with one embodiment of the present invention.

Referring to FIGS. 10, 11A, and 11B, one embodiment of a speaker grill mounting arrangement 750 illustrated. The mounting arrangement 750 may, for example, correspond to the mounting arrangement shown in FIGS. 9A and 9B. FIG. 10 is a perspective view of the mounting arrangement 750 including a housing-side mount 752 and a grill-side mount 754 capable of engaging the housing-side mount 752. FIG. 11A is a side elevation view, in cross section, showing the grill-side mount 754 disengaged from the housing-side mount 752. FIG. 11B is a side elevation view, in cross section, showing the grill-side mount 754 engaged with the housing-side mount 752.

The grill-side mount 754 includes a fastener 760, a standoff 762, a base 764, a neck 766 and a ball 768. The fastener 760 attaches to the speaker grill 756. By way of example, the fastener 760 may be a screw that threads into an opening in the frame of the speaker grill 756. The standoff 762 provides a gap between the speaker grill 756 and the base 764 thereby forming a recess for trapping a dampening ring 770. The neck 766 positions the ball 768 in its desired location relative to the base 764. The grill-side mount 754 may be formed from any suitable material including plastics and metals. In one example, the grill-side mount is formed from stainless steel.

The dampening ring 770 mentioned above is configured to dampen the vibration of the speaker grill 756 in order to eliminate noise (e.g., chatter) that can occur between the speaker grill 756 and a housing wall 758 especially when the speaker grill 756 is located closely to the housing wall 758 (small gap). In one embodiment, the dampening ring 770 includes a base 772 with an opening 774 that surrounds the standoff 762, and a tube portion 776 that extends from the base 772. The base 772 is trapped between the base 764 of the grill-side mount 756 and the speaker grill 756 inside the recess. The tube portion 776 surrounds and extends past the base 764 of the grill-side mount 756. The ends of the tube portion 776 are configured to contact either the housing wall 758 or the housing-side mount 752 when the grill-side mount 754 is attached thereto. Furthermore, the dampening ring 770 is configured to be sandwiched between the housing wall 758 (or the housing-side mount 752) and the speaker grill 756 when the grill-side mount 754 is fully engaged with the housing-side mount 752. The dampening ring 770 may be formed from any suitable dampening material. By way of example, the dampening ring 770 may be formed from rubber or rubber like materials.

The housing-side mount 752 includes a cap 780, a receptacle 782 and a retainer ring 784. The cap 780 includes an opening 786 for receiving the ball 768 therethrough. The cap 780 also includes a receiver section 788 for guiding and locating the ball 768 relative to the opening 786. The receiver section 788 may, for example, include a taper or curved surface. The cap 780 also includes a shoulder portion 792 that abuts against the surface of the housing wall 758 and a base portion 794 that extends through an opening 759 in the housing wall 758. By way of example, the shoulder and base portions 792 and 794 may be glued to the housing wall 758. The receptacle 782 includes an end portion 796 that closes off the opening 786 and a tube portion 798 that is snugly fitted within the base portion 794 of the cap 780. The end and tube portions 796 and 798 form a void 800 for receiving the ball 768 when the grill-side mount 754 is coupled to the housing-side mount 752. The tube portion 798 also is configured to create a recess 802 between its end and the receiver portion 788 of the cap 780. The recess 802 is configured to trap the retainer ring 784 therein. The cap 780 and the receptacle 782 may be formed from any suitable material including plastics and metals. In one example, they are formed from plastic.

The retainer ring 784 is configured to capture the ball 768 inside the void 800 created by the receptacle 782. The retainer ring 784 generally has an inside diameter that is smaller than the diameter of the ball 768. However, because the retainer ring 784 includes a cut out, the ring 784 is capable of bending outwardly away from its center axis. The recess 802 is preferably dimensioned to allow for this expansion of the retainer ring 784. Furthermore, the retainer ring 784 includes a tapered section 804 and 806 on both sides of its opening for smoothly guiding the ball 768 therethrough in either direction. In fact, the tapered sections 804 and 806 may help pull the ball 768 into the void 800 and push the ball 768 out of the opening 786. Furthermore, the pushing and pulling nature of the retainer ring 784 may provide feedback in the form of an audio and tactile click upon engagement and disengagement therefrom thereby alerting a user as to when the grill is engaged or disengaged (the retainer ring snapping back to position creates an pulsed vibration and click). The retainer ring 384 may be formed from any suitable material including plastics and metals. In one example, it is formed from plastic.

Figure 12:
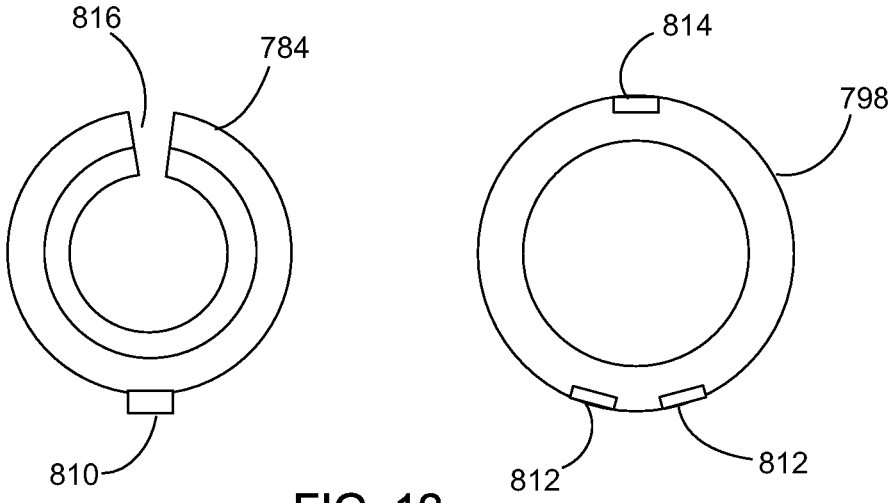
FIG. 12 is a diagram showing a retainer ring configuration in accordance with one embodiment of the present invention.

Although the retainer ring 784 may float in the recess 802, in some cases as shown in FIG. 12, the retainer ring 784 may include a protrusion 810 that helps secure the retainer ring 784 inside the recess 802. In one embodiment, the end of the tube portion 798 includes a pair of protrusions 812 that form a recess for placement of the retainer ring protrusion 810. The end of the tube portion 798 may also include another protrusion 814 that sits within the cut out section 816 of the retainer ring 784.

The operation of the mounts will now be described. During engagement, the ball 768 comes into contact with the receiver portion 788 of the cap 780. The receiver portion 788 because of its taper helps guide the ball 768 to the opening 786 in the cap 780. During further insertion, the ball 768 comes into contact with the retainer ring 784. The ball 768 pushes against the tapered section 804 of the retainer ring 784 thereby expanding the retainer ring 784. When a sufficient force has been exerted, the ball 768 makes it completely though the retainer ring 784 and the tapered section 806 on the other side of the retainer ring 784 pulls the ball 768 into the void 800. At this time, the dampening ring 770 is sandwiched between the speaker grill 756 and the cap 780, which is an extension of the housing wall 758. Because the dampening ring 770 is typically formed from a deformable material, the dampening ring 770 compresses under the engagement force. The speaker grill 756 is therefore held tight against the housing wall 758, and the vibration generated by speakers blasting is absorbed by the dampening ring 770. As a result, the speaker grill 756 tends not to vibrate and as such undesired noise (e.g., chatter) is substantially eliminated.

During disengagement, the ball 768 comes into contact with the tapered section 806 of the retainer ring 784. The ball 768 pushes against the tapered section 806 of the retainer ring thereby expanding the retainer ring 784. When a great enough force has been exerted, the ball 768 makes it completely though the retainer ring 784 and the tapered section 804 on the other side of the retainer ring 784 pushes the ball 768 out of the opening 786. As a result, the ball 768 is released and the speaker grill 756 can be removed from housing wall 758.

According to still another aspect of the invention, a power port for receiving a power plug is provided within a continuous surface of the housing of a sound system. As such, the housing wall is preserved from lines and cracks thereby improving the aesthetic appearance and sound quality of the sound system.

Figure 13:
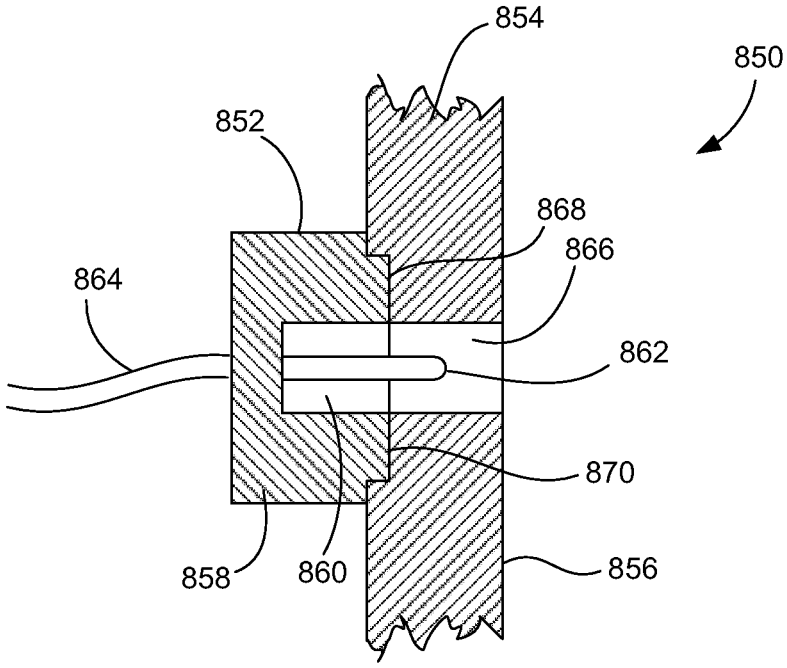
FIG. 13 is a side elevation view, in cross section, of a power plug arrangement in accordance with one embodiment of the present invention.
Figure 14:
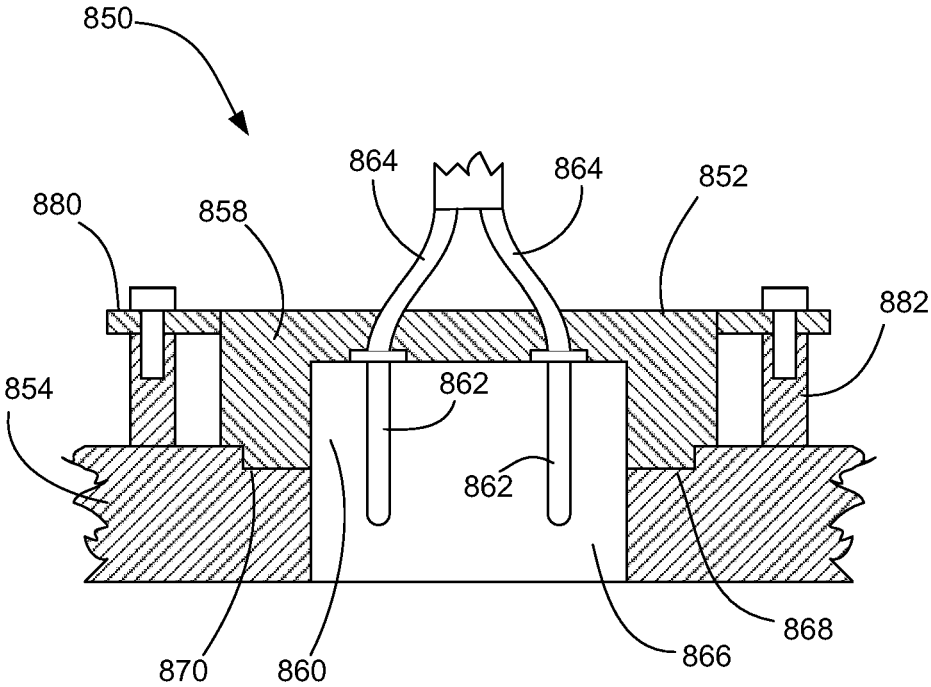
FIG. 14 is a side elevation view, in cross section, of a power plug arrangement in accordance with one embodiment of the present invention.
Figure 15A:
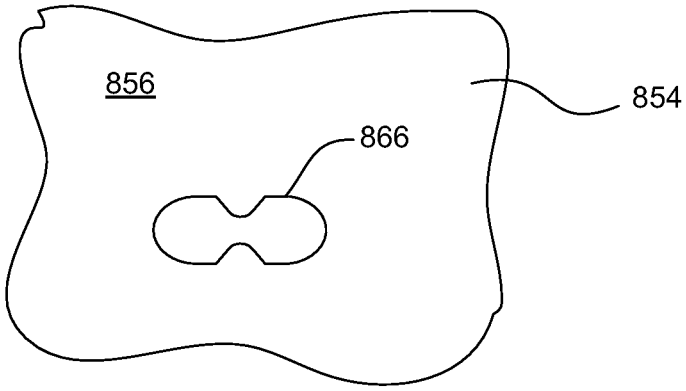
FIG. 15A is a front view of a housing for the power plug arrangement in accordance with one embodiment of the present invention.
Figure 15B:
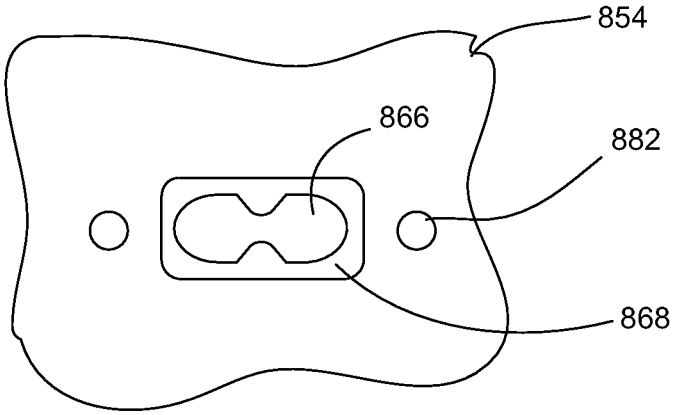
FIG. 15B is a rear view of a housing for the power plug arrangement in accordance with one embodiment of the present invention.
Figure 16:
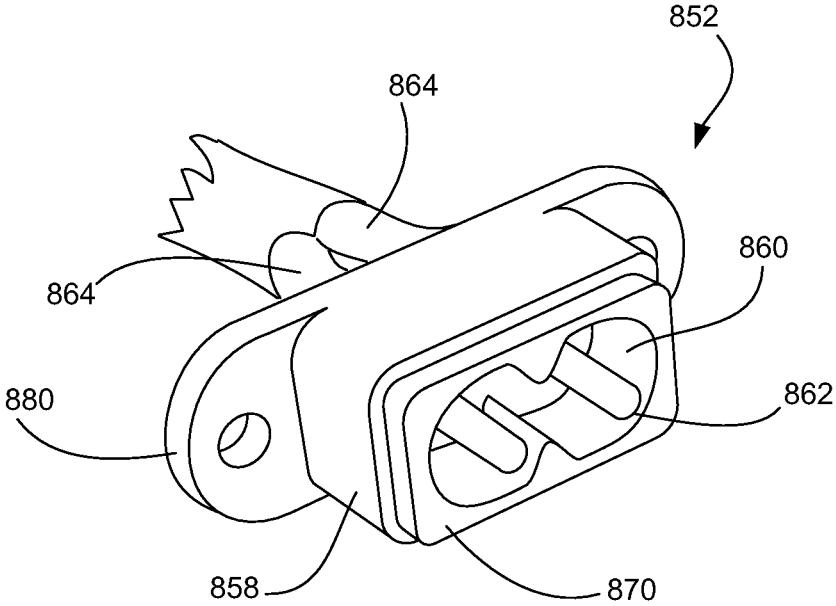
FIG. 16 is a perspective view of a fixture for the power plug arrangement in accordance with one embodiment of the present invention.

Referring to FIGS. 13-16, one embodiment of a power plug system 850 will be described. The power plug system 850 can also be referred to as a power plug arrangement and may, for example, be used in an electronic device, such as the sound system 500 shown in FIG. 5. FIG. 13 is a side elevation view, in cross section, of a power plug arrangement in accordance with one embodiment of the present invention. FIG. 14 is a side elevation view, in cross section, of the power plug arrangement. FIG. 15A is a front view of a housing for the power plug arrangement. FIG. 15B is a rear view of a housing for the power plug arrangement in accordance with one embodiment of the present invention. FIG. 16 is a perspective view of a fixture for the power plug arrangement in accordance with one embodiment of the present invention.

The power plug system 850 includes a fixture 852 that is mounted to the backside of a housing wall 854 so that the outer surface 856 of the housing wall 854 is left undisturbed (e.g., no lines or breaks due to the fixture). The fixture 852 includes a body 858 having void 860. The void 860 is sized and shaped for a snug fit with a power connector at the end of a power cable. That is, the void 860 has an inner perimeter that coincides with an outer perimeter of the power connector (e.g., substantially same size and shape). The fixture 852 also includes spatially separated power contacts 862 disposed inside and extending out of the void 860. The power contacts 862 are supported by the back wall of the base 858. In some cases, the power contacts 862 are press fit into the back wall. In other cases, the power contacts 862 are embedded in the back wall. Each of the power contacts 862 are electrically coupled to a separate wire 864, the ends of which may also be disposed within the back wall. The ends of the wires 864 may for example be soldered to the power contacts 862 and embedded within the back wall. Although not shown, the wires 864 connect the fixture 852 to a power supply or power management circuit of the sound system.

The housing wall 854 includes an opening 866 therethrough. Like the void 860, the opening 866 is sized and shaped for a snug fit with a power connector at the end of a power cable. That is, the opening 866 has an inner perimeter that coincides with an outer perimeter of the power connector (e.g., substantially same size and shape). The opening 866 in the housing wall 854 is aligned with the void 860 in the fixture 852 in order to form the interior space that physically receives the power connector. That is, the void 860 cooperates with the opening 866 to form the power plug socket of the sound system. Furthermore, as shown, the power contacts 862 extend through the void 860 and partially into the opening 866 so that the power contacts 862 are properly placed relative to the outer surface 856 of the housing wall 854. A portion of the power contacts 862 are positioned within the void 860 and a portion of the power contacts 862 is positioned within the opening 866.

In order to ensure the proper alignment between the void 860 and the opening 866, the inner surface of the housing wall 854 may include a recessed portion 868 that physically receives an end portion 870 of the base 858. That is, the end portion 870 and the recess 868 have the same shape and thus their edges serve to align the void 860 with the opening 866. In some cases, the end portion 870 may be stepped inward from the rest of the base 858 to provide further support to the mating interface. Any suitable technique can be used to attach the fixture 852 to the housing wall 854 including, for example, heat staking, fasteners, glues, snaps, and the like. In the illustrated embodiment, the base 858 includes tabs 880 that rest on posts 882 of the housing 854. The tabs 880 include a through hole for receiving a screw that threads into the post 882 thereby securing the fixture 852 to the housing 854.

In some embodiments, in addition to spatially separated power contacts 862, power plug system 850 can include at least an earth (or ground) contact that provides a dedicated connection to ground. In this way, power plug system can be configured to be used with any of a number of wiring systems used throughout the world.

Although the power plug system discussed above is directed at power plugs, the various aspects of the invention may be applied to other types of connectors as for example data connectors (e.g., USB, parallel, serial, Firewire, etc.). The media items (media assets) can pertain to one or more different types of media content. In one embodiment, the media items are audio tracks. In another embodiment, the media items are images (e.g., photos). However, in other embodiments, the media items can be any combination of audio, graphical or video content.

In one embodiment, a portable media device is a portable computing device dedicated, at least in part, to processing media such as audio, video or images. For example, a portable media device can be a media player (e.g., MP3 player, video player), a game player, a video recorder, a camera, an image viewer and the like. These devices are generally battery operated and highly portable so as to allow a user to listen to music, play games or videos, record video or take pictures wherever the user travels. In one implementation, the media player is a handheld device that is sized for placement into a pocket or hand of the user. By being handheld, the media player is relatively small and easily handled and utilized by its user. By being pocket-sized, the user does not have to directly carry the device and therefore the device can be taken almost anywhere the user travels (e.g., the user is not limited by carrying a large, bulky and often heavy device, as in a portable computer). Furthermore, the device may be operated by the user's hands, no reference surface such as a desktop is needed.

The various aspects, embodiments, implementations or features of the invention can be used separately or in any combination.

The invention can be implemented by software, hardware, or a combination of hardware and software. Some embodiments of the invention can also be embodied as computer readable code on a computer readable medium. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A media delivery apparatus having a housing including audio output circuitry and at least one speaker, and the media delivery apparatus having a removable cover to cover said at least one speaker, comprising an audio output subsystem that produces audio signals, wherein said at least one speaker is operatively connected to receive the audio signals from said audio output circuit;

a removable cover for said at least one speaker, wherein the removable cover is configured to be attached to a housing of the media delivery apparatus by a mounting arrangement that provides a gap between the removable cover and the housing of the media delivery apparatus;

a cover detection circuit operatively connected to provide a cover detection signal to said audio output subsystem based on whether or not said removable cover is attached or not, wherein the audio signals supplied to said at least one speaker have at least one audio characteristic that varies depending on the cover detection signal, wherein the housing includes a housing wall that includes an opening for receiving a connector therethrough;

a fixture mounted to an inner surface of the housing wall so that an outer surface of the housing wall is continuous, the fixture including a body having a void for receiving the connector therein, and one or more electrical contacts disposed inside and extending outside the void, the void cooperating with the opening of the housing wall to form the interior space that receives the connector, the one or more electrical contacts extending partially into the opening in the housing wall; and a removable access door for placement inside the access opening, the removable access door including a retention plate that slides in and out of an opening in the removable access door, the retention plate sliding between a disengaged position where the retention plate is contained within the perimeter of the removable access door, and an engaged position where the retention plate extends out of and past the perimeter of the removable access door in order to mate with the slot disposed within the access opening thereby securing the removable access door within the access opening of the housing wall.

2. A media delivery apparatus as recited in claim 1, wherein the at least one audio characteristic pertains to equalization settings.

3. A media delivery apparatus as recited in claim 1, wherein the cover detection signal provided by said cover detection circuit indicates whether said removable cover is attached to or removed from the housing.

4. A media delivery apparatus as recited in claim 3, wherein when altering the at least one audio characteristic of the resulting audio, a first predetermined set of equalization levels are used when said removable cover is determined to be attached, and a second predetermined set of equalization levels are used when said removable cover is determined to be removed.

5. A media delivery apparatus as recited in claim 1, wherein said media delivery apparatus is a portable media player box.

6. A media delivery apparatus as recited in claim 1, wherein said media delivery apparatus includes a plurality of speakers, and wherein said removable cover serves to cover the plurality of speakers.

7. A media delivery apparatus as recited in claim 1, wherein, when attached, said removable cover imposes a fabric in front of said at least one speaker.

8. A media delivery apparatus as recited in claim 1, wherein said cover detection circuit includes at least a switch.

9. A media delivery apparatus as recited in claim 1, further comprising:

a mounting arrangement for detachably coupling a speaker grill to the housing of the media delivery apparatus, the mounting arrangement comprising:

a housing-side mount attached to the housing of the media delivery apparatus, the housing-side mount including a receptacle and a holding detect mechanism within the receptacle; and a grill-side mount attached to the speaker grill, the grill-side mount including a post that when inserted into the receptacle is held in the receptacle by the holding detent mechanism, thereby removably attaching the speaker grill to the housing, wherein the speaker grill is separated from the housing by a gap when the post of grill-side mount is inserted into the receptacle.

10. A media delivery apparatus as recited in claim 9, wherein said mounting arrangement further comprises:

a dampening mechanism disposed between the speaker grill and the housing.

11. A media delivery apparatus as recited in claim 9, wherein the holding detent mechanism includes one or more holding flexures and wherein the post includes a recess for receiving the holding flexures, the holding flexures being biased inwardly towards a centerline of the receptacle, wherein during insertion the end of the post causes the holding flexures to bend outwardly and wherein upon further insertion the flexures resume there inwardly biased state inside the recess thereby holding the post within the receptacle.

12. A media delivery apparatus as recited in claim 9, wherein the post includes a base, a ball and a neck disposed between the base and the ball, wherein the housing-side mount includes a cap having an opening for receiving the ball therethrough so that the ball can be placed within a void of the receptacle, and wherein the holding detent mechanism is a retainer ring that is trapped between the opening in the cap and the void of the receptacle, the retainer ring bending outwardly away from its axis when the ball is pushed or pulled between the opening and the void, the retainer ring capturing the ball when the ball is pushed therethrough and releasing the ball when the ball is pulled therethrough.

13. A media delivery apparatus as recited in claim 12, wherein said mounting arrangement further comprises:

a dampening ring that is trapped between the speaker grill and the post, the dampening ring including a tube portion that extends along the neck of the post, the ends of the dampening ring being configured to come in contact with the housing-side mount when the grill-side mount is fully engaged with the housing-side mount.

14. A media delivery apparatus as recited in claim 9, wherein said mounting arrangement further comprises:

a dampening device that is trapped between the speaker grill and the post.

15. A media delivery apparatus as recited in claim 14, wherein the dampening device is configured to come in contact with the housing-side mount when the grill-side mount is fully engaged with the housing-side mount.

16. A media delivery apparatus as recited in claim 1, further comprising:

a docking station integrated within a top wall of the housing, the docking station allowing a handheld media player to interact with the media delivery apparatus, the docking station including a media bay capable of physically receiving the handheld media player and a connector arrangement disposed within the media bay for operatively coupling the handheld media player to the operational components of the media delivery apparatus.

17. A media delivery apparatus as recited in claim 16, wherein said media delivery apparatus further comprises:

one or more input mechanisms for controlling some aspect of the handheld media player when the handheld media player is docked within the docking station.

18. A media delivery apparatus as recited in claim 16, wherein said media delivery apparatus further comprises:

at least one dampening device disposed between the speaker grill and the housing wall.

19. A media delivery apparatus as recited in claim 16, wherein the mounting arrangement comprises:

a housing-side mount attached to the housing of the media delivery apparatus, the housing-side mount including a receptacle and a holding detect mechanism within the receptacle; and a grill-side mount attached to the speaker grill, the grill-side mount including a post that is inserted into the receptacle and held in the receptacle by the holding detent mechanism.

20. A media delivery apparatus as recited in claim 16, wherein said media delivery apparatus further comprises:

a removable access door that covers and seals a battery cavity of the portable sound system, the removable access door including a retention plate that slides in and out of an opening in the removable access door, the retention plate sliding between a disengaged position where the retention plate is contained within the perimeter of the removable access door, and an engaged position where the retention plate extends out of and past the perimeter of the removable access door in order to mate with a slot disposed within the battery cavity thereby securing the removable access door in front of the battery cavity.

21. A media delivery apparatus as recited in claim 16, wherein said portable sound system further comprises:

a power socket formed by a portion of a wall of the housing so that the wall of the housing can maintain a continuous appearance without gaps, lines or breaks.

22. A media delivery apparatus as recited in claim 21, wherein the access opening includes a recessed portion disposed around the perimeter of the access opening, the recessed portion receiving a back side of the removable access door, the recessed portion placing the outer surface of the removable access door substantially flush with the outer surface of the housing wall adjacent the access opening when the removable access door is disposed within the access opening and abutting against the recess portion.

23. A media delivery apparatus as recited in claim 21, wherein the removable access door includes a rotating member on its exposed side for driving the retention plate between the engaged and disengaged positions.

24. A media delivery apparatus as recited in claim 21, wherein the housing includes a second slot within the access opening, the second slot being positioned opposite the first slot, and wherein the removable access door includes a lip for placement within the second slot, the lip being positioned opposite the retention plate.

25. A media delivery apparatus as recited in claim 21, wherein the removable access door comprises an outer shell and an inner shell that form an enclosure that slidably retains the retention plate therein, the outer and inner shell defining an opening that allows the retention plate to slide in and out of the enclosure between the engaged and disengaged positions.

26. A media delivery apparatus as recited in claim 1, wherein the inner surface of the housing wall includes a recessed portion surrounding the opening, the recessed portion receiving therein an end portion of the body of the fixture.

27. A media delivery apparatus as recited in claim 26, wherein the housing wall includes posts and the fixture includes tabs that rest on the posts.

28. A media delivery apparatus as recited in claim 1, wherein the one or more electrical contacts includes at least one ground contact.

* * * * *